US009186301B2

(12) United States Patent
Omura et al.

(10) Patent No.: US 9,186,301 B2
(45) Date of Patent: Nov. 17, 2015

(54) MEDICINE DISPENSING APPARATUS

(75) Inventors: Yoshihito Omura, Tokyo (JP); Syunji Ohgaya, Tokyo (JP)

(73) Assignee: TOSHO INC., Tokyo (JP)

( * ) Notice: Subject to any disclaimer, the term of this patent is extended or adjusted under 35 U.S.C. 154(b) by 106 days.

(21) Appl. No.: 13/997,483

(22) PCT Filed: Sep. 5, 2011

(86) PCT No.: PCT/JP2011/070187
§ 371 (c)(1),
(2), (4) Date: Jun. 24, 2013

(87) PCT Pub. No.: WO2012/086270
PCT Pub. Date: Jun. 28, 2012

(65) Prior Publication Data

US 2013/0270291 A1 Oct. 17, 2013

(30) Foreign Application Priority Data

Dec. 24, 2010 (JP) ..... 2010-288960

(51) Int. Cl.
*B65G 59/00* (2006.01)
*B65H 1/00* (2006.01)
*A61J 7/00* (2006.01)
*G07F 17/00* (2006.01)
(Continued)

(52) U.S. Cl.
CPC ..... *A61J 7/0084* (2013.01); *B65D 83/04* (2013.01); *G07F 17/0092* (2013.01); *B65B 5/103* (2013.01)

(58) Field of Classification Search
CPC ..... B65B 1/06; A61J 7/0084; B65D 83/04; G07F 17/0092
USPC ..... 221/92, 21, 123, 133, 278, 263, 124; 53/237, 473, 52, 168, 411
See application file for complete search history.

(56) References Cited

U.S. PATENT DOCUMENTS 5,481,855 A * 1/1996 Yuyama ..... 53/493
5,787,678 A * 8/1998 Koike ..... B65B 39/002 221/124

(Continued)

FOREIGN PATENT DOCUMENTS

EP 2111838 A2 * 10/2009
JP 02269601 A * 11/1990

(Continued)

OTHER PUBLICATIONS

Australian Patent Examination Report issued Jun. 1, 2015, 3 pages.

*Primary Examiner* — Rakesh Kumar
(74) *Attorney, Agent, or Firm* — Rankin, Hill & Clark LLP

(57) ABSTRACT

A tablet dispensing apparatus that allows easy cleaning of the inner surfaces of temporary storage structures. A simultaneous driving mechanism and a plurality of open-close mechanisms of a plurality of temporary storage structure are coupled to each other by a plurality of coupling structures. The coupling structures are each configured to release the coupling when the entire temporary storage structure or a portion, which includes the open-close mechanism, of the temporary storage structure is drawn out of a housing, and to establish the coupling when the entire temporary storage structure or the portion, which includes the open-close mechanism, of the temporary storage structure is pushed into the housing.

13 Claims, 18 Drawing Sheets

(51) Int. Cl.
*B65D 83/04* (2006.01)
*B65B 5/10* (2006.01)

(56) References Cited

U.S. PATENT DOCUMENTS 5,960,988 A * 10/1999 Freixas ..... A47F 1/04 221/13
6,585,132 B2 * 7/2003 Kim ..... 221/133
6,792,736 B1 * 9/2004 Takahashi et al. ..... 53/237
7,398,895 B2 * 7/2008 Kim ..... 221/154
7,438,201 B2 * 10/2008 Kim ..... B65B 5/103 221/200
7,637,078 B2 * 12/2009 Ishiwatari ..... B65B 5/103 221/21
7,690,529 B2 * 4/2010 Kim ..... B65B 5/103 221/133
7,721,508 B2 * 5/2010 Yuyama et al. ..... 53/249
7,770,357 B2 * 8/2010 Yuyama et al. ..... 53/167
7,827,764 B2 * 11/2010 Yuyama et al. ..... 53/247
8,308,414 B2 * 11/2012 Schifman ..... G07F 11/44 100/10
2009/0266029 A1 10/2009 Kim
2013/0270291 A1 * 10/2013 Omura ..... B65D 83/04 221/92

FOREIGN PATENT DOCUMENTS

JP 2001-087353 4/2001
JP 2004-148036 5/2004
JP 2005-192702 7/2005
JP 2006-109860 4/2006
JP 2007-209600 8/2007
JP 2009-261932 11/2009

* cited by examiner

MEDICINE DISPENSING APPARATUS

TECHNICAL FIELD

The present invention relates to a medicine dispensing apparatus configured to store various types of medicines (including tablets such as pills and capsules) and separately pack the medicines according to input based on a prescription or a pharmaceutical indication to automatically discharge the medicines.

BACKGROUND ART

The structure etc. of a tablet dispensing apparatus as a typical example of a medicine dispensing apparatus according to the related art will be described with reference to FIG. 10. FIG. 10*a* is a perspective view showing the appearance of a tablet dispensing apparatus 10 according to the related art as seen from the left front. FIG. 10*b* is a schematic view showing the internal structure of the tablet dispensing apparatus 10. FIG. 10*c* is a perspective view showing the appearance of the tablet dispensing apparatus 10 as seen from the left front. FIG. 10*d* is a left side view of another tablet dispensing apparatus 20 according to the related art including a manual medicine dispenser (21, 22).

The tablet dispensing apparatus 10 shown in FIGS. 10*a* to 10*c* are not provided with a manual medicine dispenser. This type of tablet dispensing apparatus is disclosed in JP 2005-192702 A (Patent Document 1) and JP 2006-109860 A (Patent Document 2), for example. The tablet dispensing apparatus 20 shown in FIG. 10*d* is obtained by integrating the tablet dispensing apparatus 10 with the manual medicine dispenser (21, 22). This type of tablet dispensing apparatus is disclosed in JP 2007-209600 A (Patent Document 3), for example.

The tablet dispensing apparatus 10 with no manual medicine dispenser includes a plurality of medicine feeders 13, a medicine collecting structure (14, 15), a packing device 17, and a controller 18 (control device). The plurality of medicine feeders 13 store various types of medicines 1 such as tablets such as pills and capsules separately according to their types. The medicine collecting structure (14, 15) collects the plurality of medicines 1 discharged from the medicine feeders 13. The packing device 17 packs the plurality of medicines 1 received from the medicine collecting structure (14, 15). The controller 18 (control device) constituted from a microprocessor system etc. outputs a control command to the plurality of medicine feeders 13 and the packing device 17. The controller 18 receives prescription data, pharmaceutical indication data, or the like and provides a control command to a medicine feeder 13 storing the medicines indicated by the received data to cause the medicine feeder 13 to discharge a necessary number of medicines 1. The medicines 1 discharged from the medicine feeder 13 are collected by the medicine collecting structure (14, 15), and fed into a medicine entry port 16 (collected medicine entry port) located therebelow. The controller 18 provided a control command to the packing device 17 to cause the packing device 17 to separate the medicines fed into the medicine entry port 16 by the dosing unit or the administering unit. The packing device 17 charges the medicines separated by the dosing unit or the administering unit into pockets separately formed between two packing strips 2 (dispensing paper), and thereafter tightly seals an opening portion of the pockets.

More particularly, a medicine storage 11 is provided in the upper space in a housing 10A of the tablet dispensing apparatus 10, and the packing device 17 is provided in the lower space therein the housing 10A. Medicine guide assemblies 14 and a medicine collecting assembly 15 serving as the medicine collecting structure are disposed in the housing between the medicine storage 11 and the packing device 17. The medicine storage 11 includes a plurality of individually slidable medicine feeder storing units 12 (medicine storage spaces) disposed side by side with each other. The medicine feeder storing units 12 each include a medicine feeder storing case 12A, and several to several tens of removable medicine feeders 13 stored inside the medicine feeder storing case 12A and arranged vertically and horizontally.

The medicine feeders 13 each include a medicine cassette and a base portion. The medicine cassette houses a large number of medicines 1 to discharge the medicines. The base portion removably supports the medicine cassette, and performs driving operation for discharging the medicines from the medicine cassette. The medicine feeders 13 are each configured to discharge a number of medicines 1, the number being specified by the controller 18, to feed the medicines 1 into the medicine guide assembly 14.

The medicine guide assemblies 14 known in the art each include a guide tube such as a duct disposed vertically, and a plurality of extended tubes configured to communicate with respective discharge ports of the plurality of medicine feeders 13. The medicine guide assembly 14 is provided for each medicine feeder storing unit 12, and drawn out of the housing 10A together with the medicine feeder storing unit 12. In FIG. 10*b*, in order to simplify the illustration, a common medicine guide assembly 14 is depicted to be provided for two medicine feeder storing units 12. In FIG. 10*c*, the medicine guide assemblies 14 are not shown.

The medicine feeder storing units 12 are each configured such that the medicine guide assembly 14 and the medicine feeders 13 can be drawn forward together with the medicine feeder storing case 12A by horizontally sliding the medicine feeder storing unit 12 forward of the housing 10A.

The medicine collecting assembly 15 is constituted from a relatively large hopper-shaped member or funnel-shaped member. The medicine collecting assembly 15 is installed in a space in the housing 10A below the medicine storage 11 to be positioned above the packing device 17. The upper opening of the medicine collecting assembly 15 opens to be wide enough to face the respective lower ends of all the medicine guide assemblies 14. The lower opening of the medicine collecting assembly 15 is tapered toward the medicine entry port 16 of the packing device 17. As a result, all the medicines 1 guided by any medicine guide assembly 14 are collected by the lower opening of the medicine collecting assembly 15 to be fed into the packing device 17. Thus, the medicine collecting assembly 15 forms a common guide passage leading from all the medicine guide assemblies 14 to the packing device 17.

A pharmaceutical indication based on specifications in a prescription or the like indicating the dose, directions for use, etc. is input by operating an operation panel 19 or from an appropriate input device or prescription ordering system (not shown). The tablet dispensing apparatus 10 discharges the medicines 1 from one or more medicine feeders 13 specified by a command from the controller 18 which has received the input pharmaceutical indication. The discharged medicines 1 are dropped into the medicine collecting assembly 15 via the medicine guide assemblies 14 and gathered by the medicine collecting assembly 15 to be put into the medicine entry port 16 of the packing device 17 from the lower exit port of the medicine collecting assembly 15. The medicines 1 fed by way of such a medicine collecting path are packed between two packing strips 2 by the packing device 17. The packing device 17 feeds the two packing strips 2, by a predetermined length at a time, and partially heat-seals the two packing strips 2 to form a medicine storing pocket. After putting the medicines into the medicine storing pocket, the packing device 17 closes the rear opening portion of the medicine storing pocket by heat sealing to separately pack the medicines. In thus automatically separately packing the medicines, the medicines 1 are supplied from appropriate medicine feeders 13 to the packing device 17 by way of the medicine collecting structure (14, 15), one or a plurality of the medicines 1 at a time.

FIG. 10*d* shows a schematic configuration of the tablet dispensing apparatus 20 with a manual medicine dispenser described in JP 2007-209600 A (Patent Document 3). As discussed above, the tablet dispensing apparatus 20 is obtained by integrating the tablet dispensing apparatus 10 with the manual medicine dispenser (21, 22). The manual medicine dispenser (21, 22) includes a preliminary dispersing portion 21 of a cassette type, for example, and an operating portion 22 of a conveyor type, for example. A large number of sectioned chambers are formed in the preliminary dispersing portion 21 in a vertical and horizontal arrangement. The upper side of each sectioned chamber is open to allow input of the medicines. The lower surface or the bottom surface of each sectioned chamber is formed from a shutter or the like to open and close to allow discharge of the medicines. The preliminary dispersing portion 21 can be drawn out of the housing of the tablet dispensing apparatus 20 to allow manually dispersion of the medicines into the sectioned chambers. While the medicines are manually put into the preliminary dispersing portion 21, the operating portion 22 automatically discharges the medicines. Specifically, the operating portion 22 is provided in the housing of the medicine dispensing apparatus 20 below the preliminary dispersing portion 21 pushed into the housing. The operating portion 22 is configured to receive the medicines 1 discharged from the sectioned chambers of the preliminary dispersing portion 21, and to feed the received medicines 1 into the packing device 17 via the medicine collecting assembly 15, by an amount corresponding to one sectioned chamber at a time.

Finally, the structure of a tablet dispensing apparatus 30 described in Japanese Patent Application No. 2010-049924 (currently not published) filed by the applicant will be described with reference to FIG. 11. In the tablet dispensing apparatus 30, not only a manual tablet dispenser 21+22 but also a temporary storage structure 31 is integrated in the housing. FIG. 11*a* is a perspective view showing the appearance of the tablet dispensing apparatus 30 as seen from the left front with all the tablet feeder storing units 12 and the temporary storage structure 31 pushed into the housing 10A. FIG. 11*b* is a schematic view showing the internal structure of the tablet dispensing apparatus 30. FIG. 11*c* is a perspective view showing the appearance of the tablet dispensing apparatus 30 as seen from the left front with one of the tablet feeder storing units 12 and the temporary storage structure 31 drawn out of the housing.

The temporary storage structure 31 is provided as an intermediate layer between the medicine guide assemblies 14 and the manual tablet dispenser 21+22 provided thereabove and the medicine collecting assembly 15 provided therebelow. The temporary storage structure 31 temporarily retains the medicines (tablets) 1 discharged from the tablet feeders 13 and dropped as guided by the medicine collecting structure 14 provided thereabove, and releases the medicines 1 at an appropriate timing to drop the medicines 1 into the medicine collecting assembly 15. Temporarily storing the medicines resolves the difference in discharge timing among the tablet feeders 13 and hence variations in fall start timing, and resolves the difference in fall path length among the medicine guide assemblies 14 and hence variations in timing when the medicines (tablets) 1 are collected due to variations in fall duration. Consequently, the medicines 1 corresponding to one pack are collectively dropped at a time into the medicine collecting assembly 15, thereby reducing the time for which the packing device 17 waits for input and contributing to speeding up of tablet packing.

The temporary storage device 31 includes as its main members a tubular member and an open-close member. The tubular member has a hollow space extending in the up-down direction or the vertical direction. The open-close member opens and closes the hollow space. In a type of temporary storage device 31, the tubular members and the open-close members are disposed in a planar matrix to correspond to the medicine guide assemblies 14 disposed in a planar matrix. In another type of temporary storage device 31, one temporary storage structure 32 is disposed for one column of the medicine guide assemblies 14. In the temporary storage device 31 of the tablet dispensing apparatus 30 shown, a plurality of the latter temporary storage structures 32 are arranged in columns. In order to open and close the open-close mechanisms for the plurality of temporary storage structures 32 at the same time, the temporary storage device 31 is also provided with a simultaneous driving mechanism 33 coupled to the temporary storage structures 32 from one end side to drive operation of the open-close mechanisms.

In the medicine dispensing apparatus according to the related art, it is occasionally necessary to remove and prevent contamination due to scattering or adhesion of the medicines. Thus, some medicine dispensing apparatuses according to the related art include a dust remover or a suction discharge device installed at an appropriate location. Providing such a dust remover or suction discharge purifying device is common to powder medicine dispensing apparatuses. As described in JP 2004-148036 A (Patent Document 4), a tablet cutting mechanism is integrated in some tablet dispensing apparatuses (see Patent Document 4, for example).

RELATED-ART DOCUMENT

Patent Document

Patent Document 1: JP 2005-192702 A
Patent Document 2: JP 2006-109860 A
Patent Document 3: JP 2007-209600 A
Patent Document 4: JP 2004-148036 A

SUMMARY OF INVENTION

Technical Problem

In the tablet dispensing apparatuses 10 and 20 according to the related art and the tablet dispensing apparatus 30 proposed by the applicant, the medicine guide assembly 14 is integrated in each tablet feeder storing unit 12. Therefore, the medicine guide assembly 14 is cleaned by first drawing the tablet feeder storing unit 12 forward out of the medicine storage 11 or the housing to expose the upper and lower ends of the medicine guide assembly 14, and inserting a cleaning tool into a hollow space from the upper and lower openings to wipe a tablet falling path surrounding surface inside the medicine guide assembly 14. Such cleaning work forces a worker to work in an unnatural posture, which not only puts a burden on the worker but also results in a low efficiency. Thus, it was desired to provide a tablet dispensing apparatus that allows easy cleaning of the inner surface of the medicine guide assembly 14. Then, the applicant developed a tablet dispensing apparatus improved such that the medicine guide assembly 14 was vertically split and the tablet falling path surrounding surface inside the medicine guide assembly was exposed as the tablet feeder storing unit 12 was drawn out.

Mechanical portions of the tablet feeder storing units 12 are separated from each other, and thus the tablet feeder storing units 12 can be improved on the premise of being individually drawn out. For the temporary storage device 31, however, the temporary storage structures 32 alone are separated among the columns, but all the temporary storage structures 32 are coupled to the identical simultaneous driving mechanism 33. Thus, the temporary storage structures 32 are installed differently from the tablet feeder storing units 12. The tablet dispensing apparatus 30 discussed above (see FIG. 11*c*) is a prototype devised and improved to allow easy cleaning work of the tablet falling path surrounding surface for the temporary storage device 31 forming an intermediate portion of the tablet falling path on the premise that the entire temporary storage device 31 is integral. In the tablet dispensing apparatus 30, the temporary storage device 31 can be drawn out forward, the temporary storage structures 32 each having a tablet falling path surrounding surface are disposed on the front side, and the simultaneous driving mechanism 33 having no tablet falling path surrounding surface is disposed on the back side.

Because the plurality of temporary storage structures 32 are arranged in parallel with each other and their tablet falling path surrounding surfaces are distributed in a plane, however, implementing only such an improvement still forces the worker to take a bent posture in cleaning the middle portion and the back-side portion of the temporary storage device 31. In addition, it is also conceivable that foreign substances unintentionally stirred up may adhere again to an already cleaned portion. This makes the cleaning work difficult and inefficient, and thus a further improvement has been desired.

An object of the present invention is to provide a medicine dispensing apparatus that allows easy cleaning of the inner surfaces of the temporary storage structures.

Solution to Problem

The present invention provides a medicine dispensing apparatus including, as its basic constituent elements, a housing, a plurality of medicine feeder storing units disposed inside the housing, a plurality of medicine guide assemblies, a plurality of temporary storage structures, a simultaneous driving mechanism, a medicine collecting assembly, and a packing device. The medicine feeder storing units are drawably arranged in the housing, and each includes a plurality of medicine feeders and a medicine feeder storing case. The plurality of medicine feeders store medicines and discharge the medicines one by one. The medicine feeder storing case stores the plurality of medicine feeders. The plurality of medicine guide assemblies are each disposed between a pair of adjacent medicine feeder storing units among the plurality of medicine feeder storing units, and guide the medicines discharged from the plurality of medicine feeders included in the pair of medicine feeder storing units to one exit port located therebelow. The plurality of temporary storage structures each include a storage portion and an open-close mechanism. The storage portion temporarily stores the medicines dropped from the medicine guide assembly. The open-close mechanism brings the storage portion into a storage enabling state upon application of a closing drive force, and brings the storage portion into a releasing state to discharge the medicines from the storage portion upon application of an opening drive force. The plurality of temporary storage structures are each provided such that the entire temporary storage structure or a portion including the open-close mechanism of the temporary storage structure is drawable out of the housing. The simultaneous driving mechanism applies the closing drive force or the opening drive force to the open-close mechanisms of the plurality of temporary storage structures. The medicine collecting assembly is disposed in the housing below the plurality of temporary storage structures to collect the medicines dropped from the plurality of temporary storage structures. The packing device is provided in the housing below the medicine collecting assembly to separately pack the medicines discharged from the medicine collecting assembly. In the present invention, a plurality of coupling structures are provided to couple the simultaneous driving mechanism and the plurality of open-close mechanisms of the plurality of temporary storage structures. The coupling structures are each configured to release a coupling between the simultaneous driving mechanism and the plurality of open-close mechanisms when the entire temporary storage structure or the portion including the open-close mechanism of the temporary storage structure is drawn out of the housing, and to establish the coupling between the simultaneous driving mechanism and the plurality of open-close mechanisms when the entire temporary storage structure or the portion including the open-close mechanism of the temporary storage structure is pushed into the housing.

Adopting such coupling structures enables the simultaneous driving mechanism and the plurality of temporary storage structures to be removably coupled to each other. As a result, the temporary storage structures can be drawn out one by one. The plurality of temporary storage structures may be individually drawn out independently or together with the medicine feeder storing units. Since the temporary storage structures can be drawn out one by one, cleaning work can be performed with only the subject of the cleaning work drawn out of the housing and with the other temporary storage structures pushed into the housing for not only the temporary storage structures at the left and right ends but also the temporary storage structures at middle locations. Therefore, the cleaning work can be performed in a comfortable posture, and re-adhesion of removed substances to the other temporary storage structures can be prevented. If the temporary storage structures are returned into the housing after each cleaning, the medicines can be temporarily stored and released at a time without hindrance through cooperation between the simultaneous driving mechanism and the temporary storage structures. Thus, according to the present invention, it is possible to provide a medicine dispensing apparatus that allows easy cleaning of the inner surfaces of the temporary storage structures. Specifically, the coupling mechanisms are provided at the coupling portion between the simultaneous driving mechanism and the temporary storage structures to releasably establish engagement therebetween. If the simultaneous driving mechanism is disposed on the back side of the housing and the plurality of temporary storage structures are disposed side by side in the left-right direction on the front side of the housing, the temporary storage structures can be drawn out forward one by one.

The medicine guide assemblies may each be constituted from first and second split guide members that are combined with each other when the pair of medicine feeder storing units are housed in the housing and that are separated from each other when one of the pair of medicine feeder storing units is drawn out of the housing. In this case, the first split guide member may be fixed to the medicine feeder storing case of one of the pair of medicine feeder storing units, and the second split guide member may be fixed to the medicine feeder storing case of the other of the pair of medicine feeder storing units. The entire temporary storage structure may be provided to one of the first and second split guide members. With such a configuration, when a pair of adjacent medicine feeder storing units are both housed in the housing, the first split guide member and the second split guide member of the medicine guide assembly are combined with each other so that the medicine guide assembly exercises its original function as a falling tablet guide passage. To clean the medicine guide assembly, only one of the pair of adjacent medicine feeder storing units is first drawn out of the housing to expose a tablet falling path surrounding surface inside the medicine guide assembly on a side surface of the drawn medicine feeder storing unit. This allows wiping or the like to be performed easily and immediately with the worker facing the surface to be cleaned. After the medicine feeder storing unit is pushed back into the housing, the other of the pair of adjacent medicine feeder storing units is drawn out. This allows the medicine guide assembly on a side surface of the other medicine feeder storing unit to be cleaned in the same manner.

The first split guide member preferably has a shape of a plate formed with a plurality of through holes configured to allow passage of the medicines discharged from the plurality of medicine feeders included in the one of the medicine feeder storing units. The second split guide member preferably includes a plate-like portion, a first sidewall portion, and a second sidewall portion. The plate-like portion is formed with a plurality of through holes configured to allow passage of the medicines discharged from the plurality of medicine feeders included in the other of the medicine feeder storing units. The first sidewall portion extends along a first edge portion of the plate-like portion, which is located in a drawing direction in which the medicine feeder storing unit is drawn, and extends in a direction away from the plate-like portion. The second sidewall portion extends along a second edge portion of the plate-like portion, which is located in the direction opposite to the drawing direction, and extends in a direction away from the plate-like portion. In this case, the first split storage member preferably has a shape of a plate integrally formed with the first split guide member. The second split storage member preferably includes an extended plate-like portion, a first extended sidewall portion, and a second extended sidewall portion. The extended plate-like portion is integrally formed with the plate-like portion of the second split guide member. The first extended sidewall portion extends along a first edge portion of the extended plate-like portion, which is located in a drawing direction in which the medicine feeder storing unit is drawn, and extends in a direction away from the extended plate-like portion to be continuous with the first sidewall portion. The second extended sidewall portion extends along a second edge portion of the extended plate-like portion, which is located in the direction opposite to the drawing direction, and extends in a direction away from the extended plate-like portion to be continuous with the second sidewall portion. This results in a structure in which the split guide members and the split storage members are continuous with each other, thereby reducing the number of components and facilitating cleaning.

For example, the open-close mechanisms of the temporary storage structures may each include a shutter plate and a driven link. The shutter plate is provided in the storage portion, and displaceable between a closed position and an opened position. The driven link is coupled to the shutter plate to displace the shutter plate by the closing drive force or the opening drive force from the simultaneous driving mechanism. In this case, the driven link is coupled to the simultaneous driving mechanism through the coupling structure. The thus configured open-close mechanism provides a simple structure, and facilitates cleaning.

The driven link may include a rotating shaft, an arm, and a coupling shaft. The shutter plate is fixed to the turning shaft, and the rotating shaft is rotatably supported by the storage portion. The arm has one end fixed to the rotating shaft, and is rotatable about the rotating shaft over a predetermined angular range. The coupling shaft is fixed to the other end of the arm, and extends in parallel with the rotating shaft. In this case, the simultaneous driving mechanism preferably includes a driving link and a swing motion generating mechanism. The driving link has an elongated fitting hole fitted with the coupling shaft. The swing motion generating mechanism rotates the rotating shaft within the predetermined angular range, with the coupling shaft reciprocally moving in the elongated fitting hole. The coupling structure is constituted from the coupling shaft and the elongated fitting hole. Adopting the thus configured mechanism and coupling structure facilitates coupling and decoupling, and allows smooth operation of the open-close mechanisms.

The swing motion generating mechanism may include a rotary motor, and a conversion mechanism configured to convert a rotational force of the rotary motor into reciprocal linear motion. In this case, the driving links for the plurality of temporary storage structures may be rotatably fixed to fulcrums respectively, one end of each of the driving links being rotatably coupled to the conversion mechanism, and the other end of each of the driving links being formed with the elongated fitting hole. Such a configuration allows the plurality of temporary storage structures to be driven at the same time with a simple structure.

The temporary storage structures may each include an elongated frame member having an upper-end opening portion and a lower-end opening portion. In this case, the rotating shaft is disposed adjacent to the upper-end opening portion and one sidewall portion of the frame member and extending along the longitudinal direction of the frame member. The one sidewall is located at one side in a width direction that is orthogonal to a longitudinal direction of the frame member. In this case, the storage portion formed above the shutter plate is brought into the storage enabling state when the rotating shaft is turned in one direction in the predetermined angular range to bring a distal end of the shutter plate into proximity to the other sidewall portion that is opposite to the one sidewall portion in the width direction. Meanwhile, the storage portion is brought into the releasing state when the rotating shaft is rotated in the other direction in the predetermined angular range to bring the shutter plate close to the one sidewall portion. With this configuration, temporary storage structures that provide a simple structure and that facilitate cleaning can be provided.

The medicine dispensing apparatus may further include an air purifying device, a purified air passage, and a purified air branch passage. The air purifying device purifies air taken from outside of the housing to supply the purified air into the housing. The purified air passage allows at least a part of the purified air to flow into the medicine guide assemblies from top to bottom. The purified air branch passage branches the purified air supplied from the air purifying device to allow a part of the branched purified air to directly flow into the packing device without passing through the purified air passage or the medicine collecting assemblies.

The air purifying device purifies air taken from outside of the housing to supply the purified air into the housing. The air purifying device is preferably disposed above the plurality of medicine feeder storing units. In addition to thus providing the air purifying device, the purified air passage is provided to allow at least a part of the purified air to flow into the medicine guide assemblies from top to bottom. Providing the thus configured purified air passage allows the purified air fed into the medicine guide assemblies from above to flow from top to bottom along the medicine falling path to be further fed into the medicine collecting assembly. Thus, the inside of the medicine guide assemblies and the inside of the medicine collecting assembly can be cleaned to some degree by the flow of the purified air. Thus, the cleaning cycle of the inside of the medicine guide assemblies can be made longer than that according to the related art. The purified air passing through the inside of the medicine guide assemblies also serves to increase the falling speed of the medicines, thereby increasing the dispensing cycle.

The purified air having passed through the medicine guide assemblies and the medicine collecting assembly enters the packing device together with the medicines while reducing its flow rate. However, the purified air may not be enough to be used to clean the inside of the packing device. Thus, the purified air branch passage is preferably provided to branch the purified air supplied from the air purifying device to allow a part of the branched purified air to directly flow to the surroundings of or into the packing device without passing through the purified air passage. Providing the thus configured purified air branch passage allows the packing device to be reliably cleaned with the purified air. As a result, it is possible to provide a medicine dispensing apparatus in which the passage for the medicines is not easily contaminated and which can mitigate the burden on the worker during the cleaning work.

DESCRIPTION OF EMBODIMENTS

A medicine dispensing apparatus according to an embodiment of the present invention will be described in detail below.

Figure 1A:
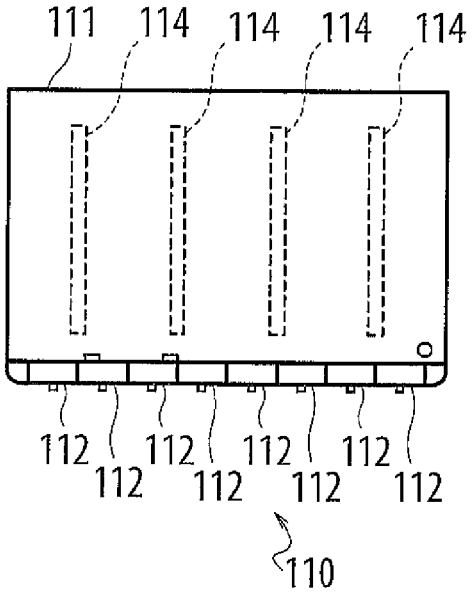
FIGS. 1*a* and 1*b* are each a plan view.
Figure 1B:
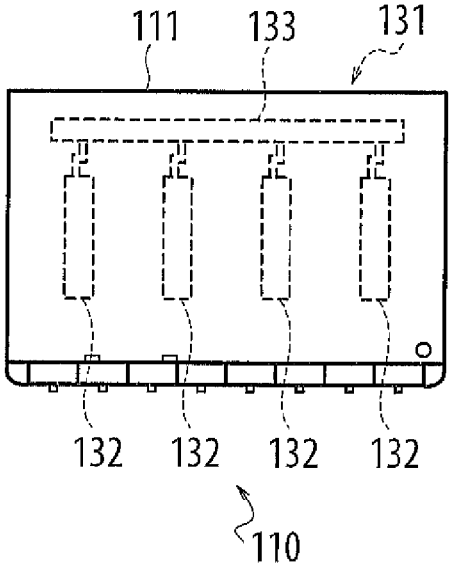
Figure 1C:
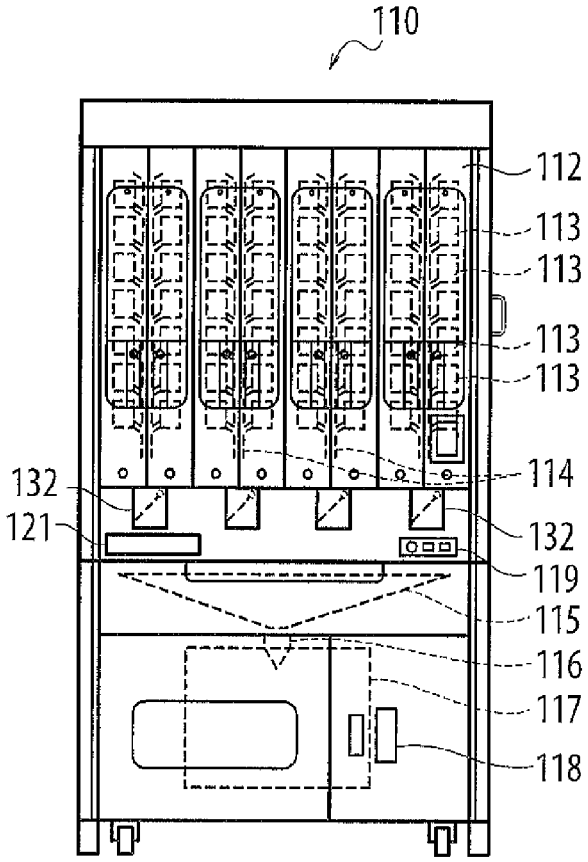
FIG. 1*c* is a front view.
Figure 1D:
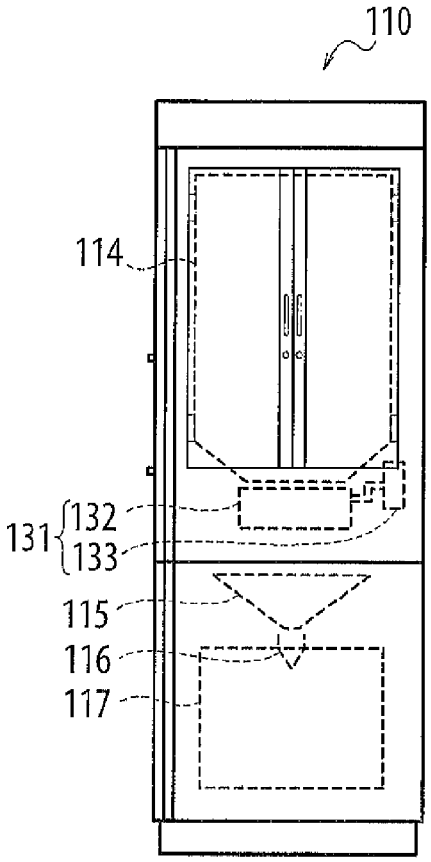
FIG. 1*d* is a right side view, showing the overall structure of a tablet dispensing apparatus according to a first embodiment of the present invention.
Figure 2A:
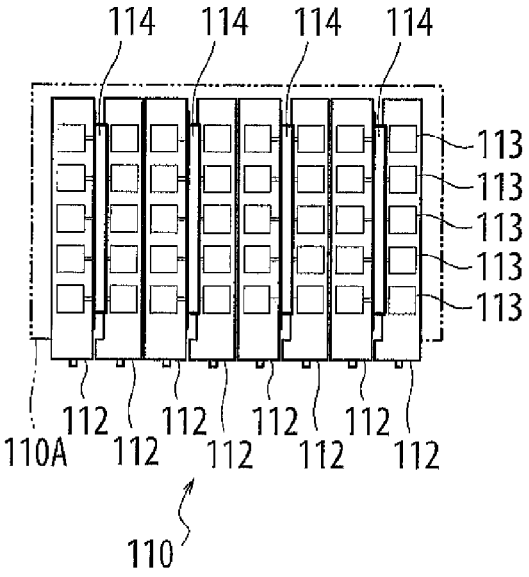
FIGS. 2*a* and 2*b* are each a plan view of an essential portion of the tablet dispensing apparatus according to the first embodiment.
Figure 2B:
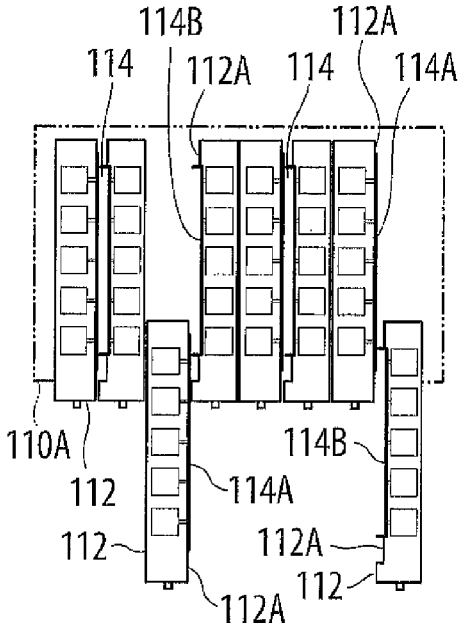

FIGS. 1 to 6 show the configuration of a medicine dispensing apparatus according to a first embodiment of the present invention. In FIGS. 1 to 3, for the sake of clarity etc., fasteners such as bolts, couplers such as hinges, driving sources such as electric motors, power transmission members such as timing belts, electric circuits such as motor drivers, and electronic circuits such as controllers are not shown in detail, and members necessary for or related to description of the present invention are mainly shown.

Figure 3A:
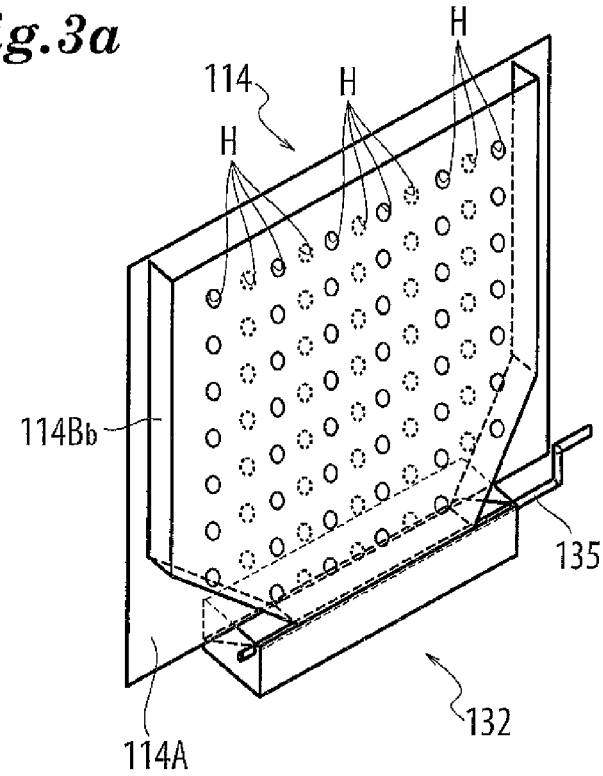
FIG. 3*a* is a perspective view of a medicine guide assembly and a temporary storage structure as seen from the right and obliquely above.
Figure 3B:
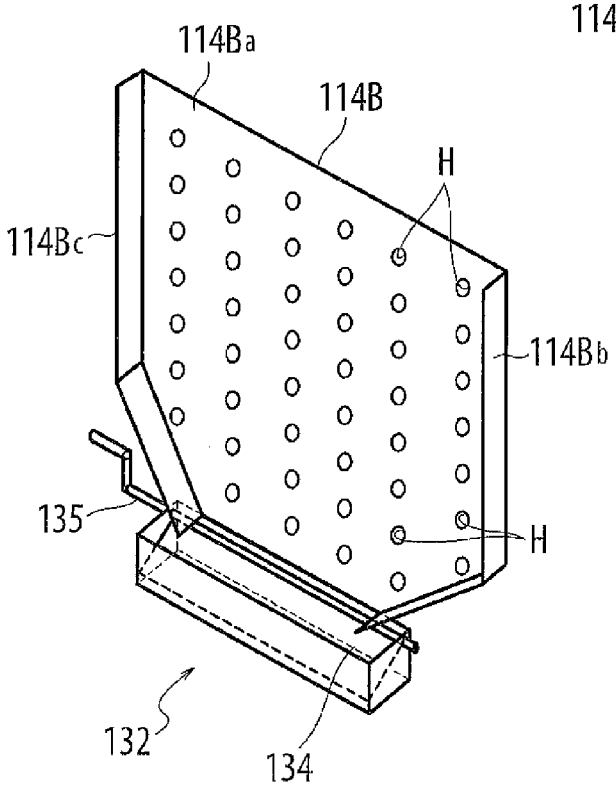
FIG. 3*b* is a perspective view of a second split guide member of the medicine guide assembly and the temporary storage structure as seen from the left and obliquely above.
Figure 4:
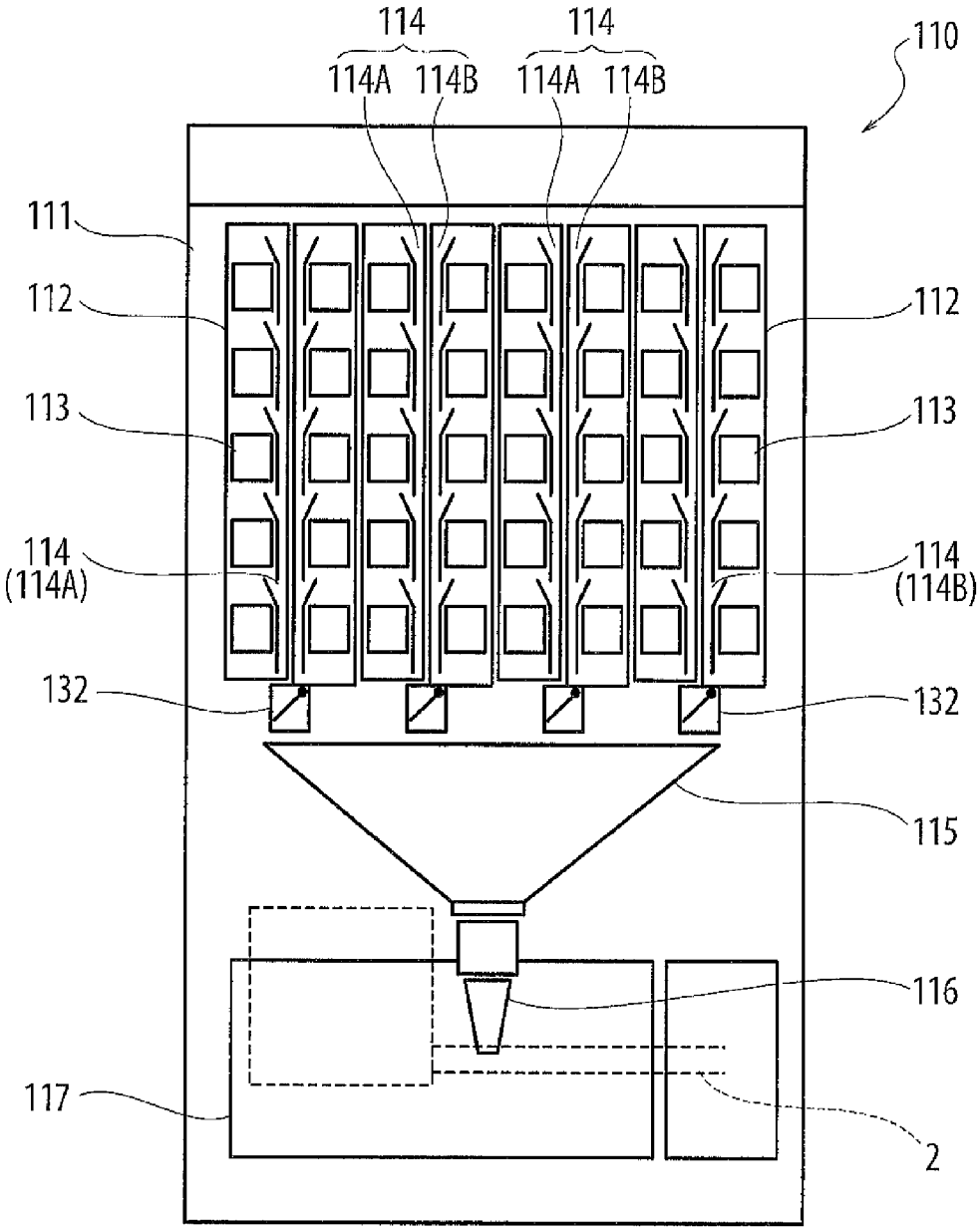
FIG. 4 is a schematic view showing the internal structure of the tablet dispensing apparatus.
Figure 5A:
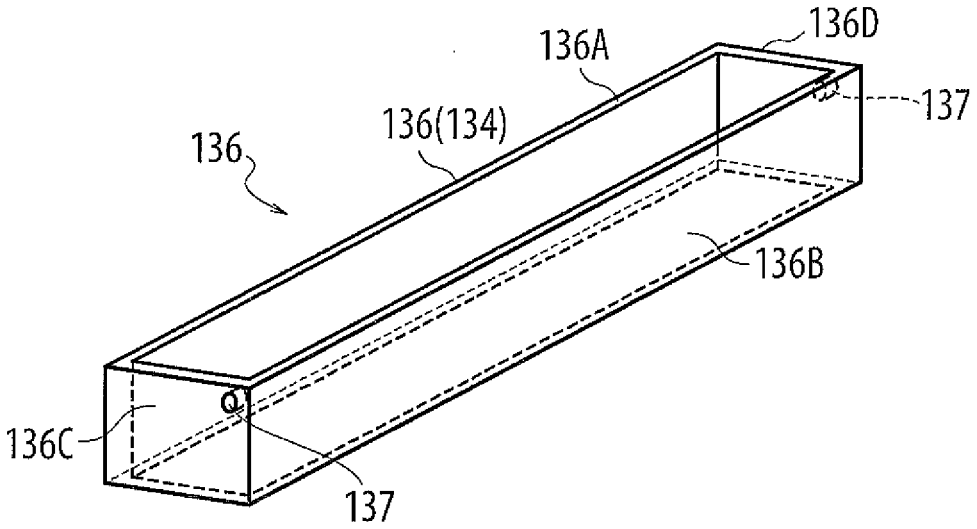
FIG. 5*a* is a perspective view of a frame member of the temporary storage structure.
Figure 5B:
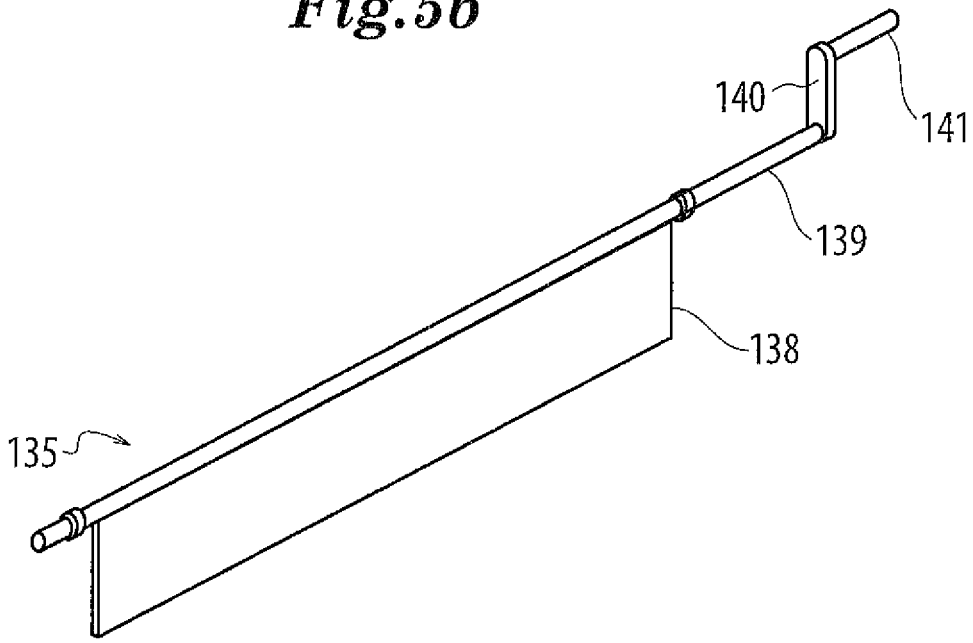
FIG. 5*b* is a perspective view of an open-close mechanism.
Figure 5C:
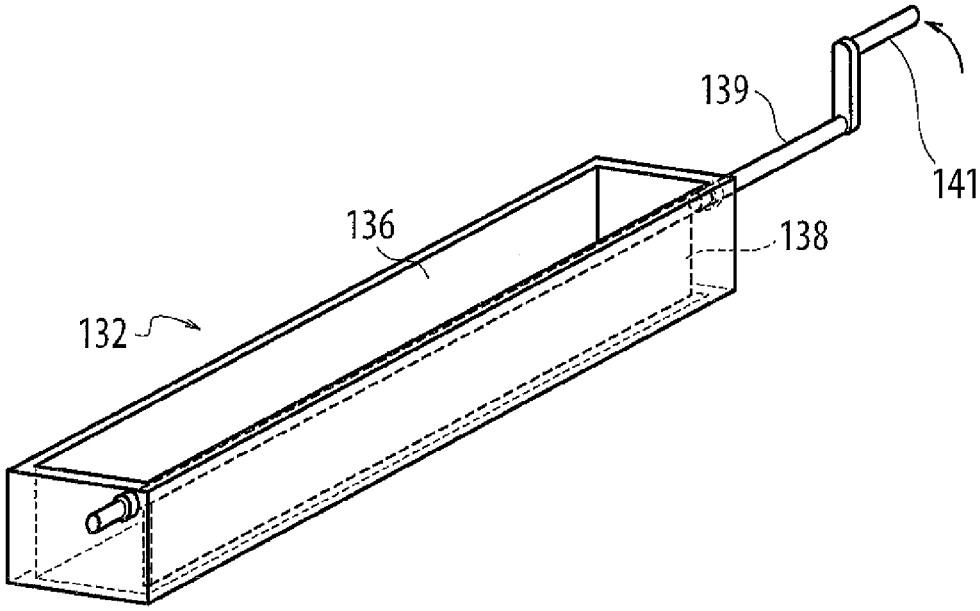
FIGS. 5*c* and 5*d* are each a perspective view of the temporary storage structure.
Figure 5D:
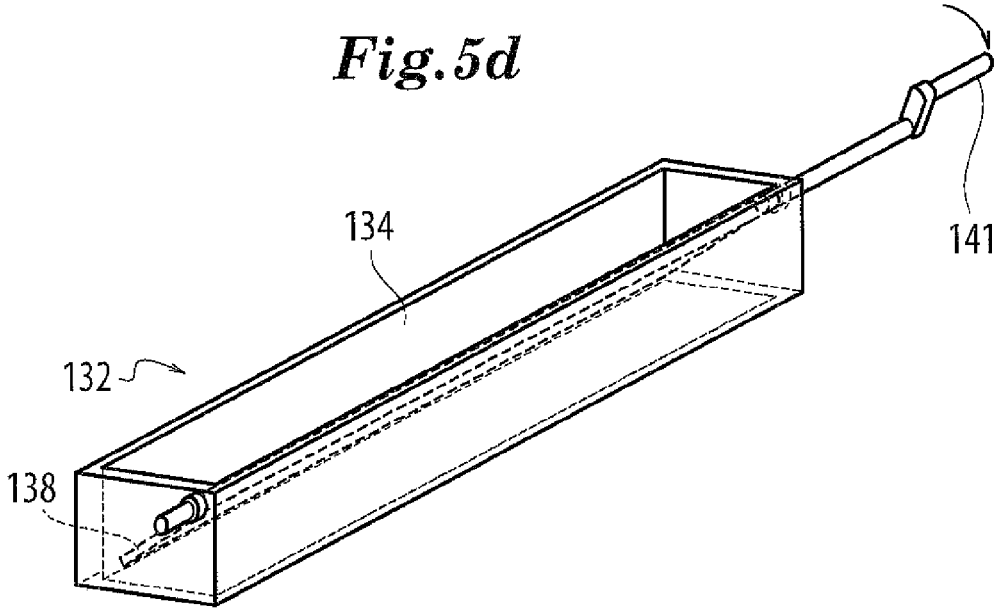
Figure 11A:
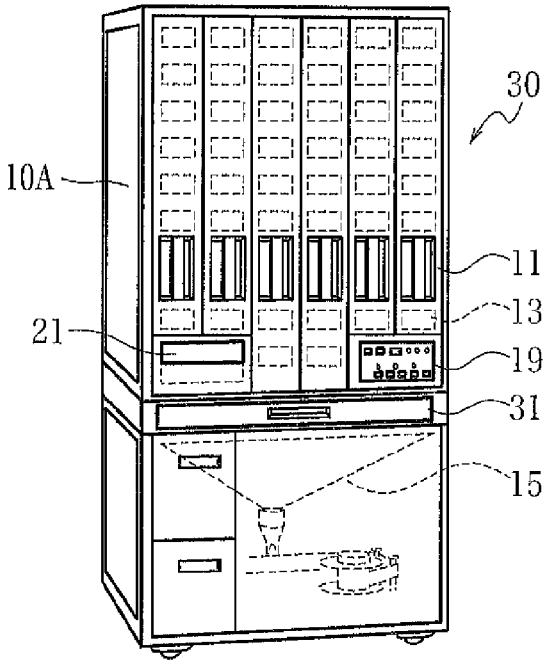
FIG. 11*a* is a perspective view showing the appearance of a tablet dispensing apparatus which is disclosed in an unpublished patent application filed by the applicant and in which a temporary storage mechanism is drawable, showing the structure of the tablet dispensing apparatus as seen from the left front.
Figure 11B:
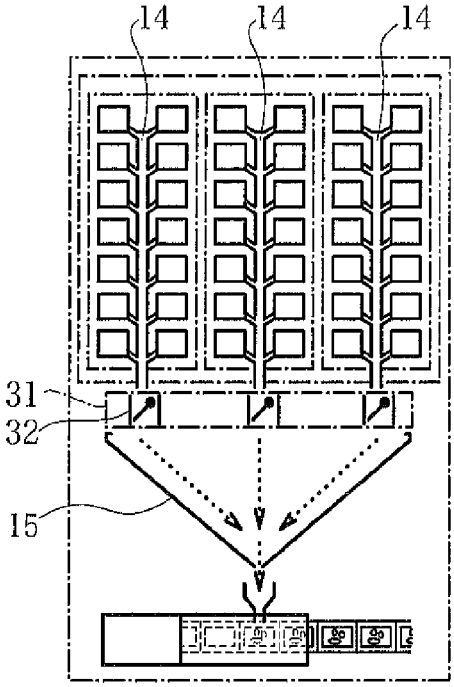
FIG. 11*b* is a schematic view showing the internal structure of the tablet dispensing apparatus.
Figure 11C:
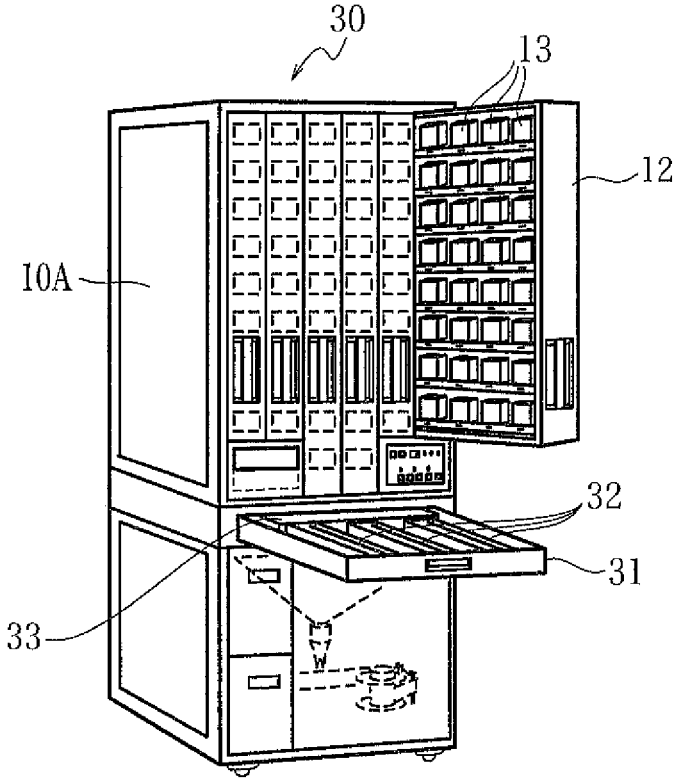
FIG. 11*c* is a perspective view showing the appearance of the tablet dispensing apparatus as seen from the left front.

In FIGS. 1 to 6, component parts similar to those of the medicine dispensing apparatus 10 according to the related art shown in FIG. 10 and the medicine dispensing apparatus 30 proposed by the applicant shown in FIG. 11 are denoted by reference numerals obtained by adding 100 to the reference numerals affixed to their counterparts in FIGS. 10 and 11. The medicine dispensing apparatus according to the embodiment is a tablet dispensing apparatus 110 which is a typical example of the medicine dispensing apparatus. FIGS. 1*a* and 1*b* are each a plan view, FIG. 1*c* is a front view, and FIG. 1*d* is a right side view, of the tablet dispensing apparatus 110 according to the embodiment. FIG. 2*a* is a plan view of a plurality of medicine guide assemblies 114 etc. with all medicine feeder storing units 112 pushed into a housing 110A indicated by the broken line. FIG. 2*b* is a plan view of the medicine guide assemblies 114 etc. with some of the medicine feeder storing units 112 drawn forward out of a medicine storage 111. FIG. 3*a* is a perspective view of an assembly including a medicine guide assembly 114 constituted from first and second split guide members 114A and 114B and a temporary storage structure 132 as seen from the right and obliquely above. FIG. 3*b* is a perspective view of the second split guide member 114B including the temporary storage structure 132 as seen from the left and obliquely above. FIG. 4 is a schematic view showing the internal structure of the tablet dispensing apparatus 110.

The tablet dispensing apparatus 110 includes eight medicine feeder storing units 112, four medicine guide assemblies 114, one medicine collecting assembly 115, one packing device 117, a controller 118, and an operation panel 119. The medicine feeder storing units 112 each include a medicine feeder storing case 112A, and a plurality of medicine feeders 113 housed in the medicine feeder storing case 112A. The plurality of medicine feeders 113 store various types of medicines such as tablets such as pills and capsules separately according to their types. The controller 118 outputs a control command to the plurality of medicine feeders 113 and the packing device 117.

The medicine storage 111 includes the eight individually slidable medicine feeder storing units 112 disposed side by side with each other.

In the embodiment, the four medicine guide assemblies 114 are each disposed between a pair of adjacent medicine feeder storing units 112 among the eight medicine feeder storing units 112. The medicine guide assembly 114 guides the medicines discharged from the plurality of medicine feeders 113 included in the pair of medicine feeder storing units 112 to an exit port located therebelow. The medicine guide assemblies 114 are each constituted from first and second split guide members 114A and 114B that are combined with each other when the pair of medicine feeder storing units 112 are housed in the housing 110A and that are separated from each other when one of the pair of medicine feeder storing units 112 is drawn out of the housing 110A. The housing 110A has open-close doors, which are opened when the medicine feeder storing units 112 are to be drawn out of the housing 110A. The first split guide member 114A is fixed to the medicine feeder storing case 112A of one of the pair of medicine feeder storing units 112. The second split guide member 114B including the temporary storage structure 132 is fixed to the medicine feeder storing case 112A of the other of the pair of medicine feeder storing units 112.

As shown in FIG. 3*a*, the first split guide member 114A has the shape of a plate formed with a plurality of through holes H configured to allow passage of the medicines discharged from medicine discharge ports of the plurality of medicine feeders 113 included in the one of the medicine feeder storing units 112. The second split guide member 114B includes a plate-like portion 114Ba, a first sidewall portion 114Bb, and a second sidewall portion 114Bc. The plate-like portion 114Ba is formed with a plurality of through holes H configured to allow passage of the medicines discharged from the plurality of medicine feeders 113 included in the other of the medicine feeder storing units 112. The first sidewall portion 114Bb extends along a first edge portion of the plate-like portion 114Ba, which is located in a drawing direction in which the medicine feeder storing unit is drawn, and extends in a direction away from the plate-like portion 114Ba. The second sidewall portion 114Bc extends along a second edge portion of the plate-like portion 114Ba, which is located in the direction opposite to the drawing direction, and extends in a direction away from the plate-like portion 114Ba. In order to increase the alignment tolerance, the width of the plate-shaped first split guide member 114A is slightly larger than that of the plate-like portion 114Ba of the second split guide member 114B. In the embodiment, the entirety of the temporary storage structure 132 to be described in detail later is fixed to the plate-like portion 114Ba. Thus, when the other of the pair of medicine feeder storing units 112 is drawn out, the second split guide member 114B and the temporary storage structure 132 are drawn out together.

The medicine guide assembly 114 constituted from the first and second split guide members 114A and 114E provided opposite to each other is open in its upper and lower ends. The medicine guide assembly 114 guides a fall of all the medicines discharged from a large number of medicine feeders 113 mounted to the corresponding pair of adjacent medicine feeder storing units 112. The lower end portion of the medicine guide assembly 114 is tapered to be slightly narrow at its lower-end opening so that the front-rear dimension of the upper opening of the temporary storage structure 132 can be reduced.

If the medicine guide assembly constituted from the first and second split guide members 114A and 114B is provided for the pair of medicine feeder storing units, the number of the medicine guide assemblies 114 can be reduced to half the number of the medicine feeder storing units 112. Thus, the product can be made compact compared to that according to the related art. Adopting such a configuration allows the medicine feeder storing unit 112 to be drawn out of the housing 110A with the inside of the first or second split guide member 114A or 114B exposed. Therefore, the inside of the first and second split guide member 114A and 114B can be individually cleaned, which makes it possible to clean the medicine guide assembly 114 without putting an excessive burden on the worker.

In the embodiment, the four temporary storage structures 132 are respectively disposed below the four medicine guide assemblies 114 to temporarily store the medicines dropped from the four medicine guide assemblies 114. The four temporary storage structures 132 are driven by a simultaneous driving mechanism 133 configured to actuate the plurality of temporary storage structures 132 at the same time to release the tablets at a time. A temporary storage device 131 is constituted from the four temporary storage structures 132 and the simultaneous driving mechanism 133.

As discussed earlier, the temporary storage structures 132 each include a storage portion 134 and an open-close mechanism 135, the storage portion 134 being configured to temporarily store the medicines dropped from the medicine guide assemblies 114, the open-close mechanism 135 being configured to bring the storage portion 134 into a storage enabling state upon application of a closing drive force and to bring the storage portion 134 into a releasing state to discharge the medicines from the storage portion 134 upon application of an opening drive force, and the temporary storage structures 132 being each provided such that the entire temporary storage structure 132 is drawable out of the housing 110A as described in detail later. The simultaneous driving mechanism 133 applies a closing drive force or an opening drive force to the open-close mechanisms 135 of the four temporary storage structures 132 at the same time. Coupling structures are provided to couple the simultaneous driving mechanism 133 and the open-close mechanisms 135 of the four temporary storage structures 132, and each configured to release the coupling when the entire temporary storage structure 132 is drawn out of the housing 110A, and to establish the coupling when the entire temporary storage structure 132 is pushed into the housing 110A. The specific configuration of the coupling structures will be described later.

As shown in FIG. 5, the temporary storage structure 132 used in the embodiment is structured by combining an elongated rectangular tubular member or an elongated frame member 136 having an upper-end opening portion and a lower-end opening portion (to form the storage portion 134), and the open-close mechanism 135. The frame member 136 (see FIG. 5*a*) includes a left sidewall portion 136A and a right side plate 136B that are thin and long in the front-rear direction, and a front plate 136C and a rear plate 136D formed with a through hole 137 provided in the upper right corner thereof. The hollow internal space serves as the tablet falling path. The open-close mechanism 135 (see FIG. 5*b*) includes a shutter plate 138, a rotating shaft 139, an arm 140, and a coupling shaft 141. The shutter plate 138 is flat, and thin and long in the front-rear direction. The rotating shaft 139 is thin and long, and the upper side of the shutter plate 138 is coupled and fixed to the rotating shaft 139. Both ends of the rotating shaft 139 are rotatably supported onto the frame member 136 (storage portion 134). The arm 140 has one end fixed to the rotating shaft 139, and is rotatable about the rotating shaft 139 over a predetermined angular range. The coupling shaft 141 is fixed to the other end of the arm 140, and extends in parallel with the rotating shaft 139. The rotating shaft 139 penetrates the through holes 137. A driven link is constituted from the rotating shaft 139, the arm 140, and the coupling shaft 141. Appropriate retainers are fixed to the rotating shaft 139.

As shown in detail in FIG. 6, the simultaneous driving mechanism 133 can actuate the four temporary storage structures 132 at the same time to release the tablets at a time. The coupling structures configured to couple the simultaneous driving mechanism 133 and the four temporary storage structures 132 removably couple the temporary storage structures 132 to the simultaneous driving mechanism 133. Therefore, the coupling structures allow individual removal of the temporary storage structures 132, and enable open-close operation of the temporary storage structures 132 connected thereto. As shown in FIGS. 6*a* and 6*b*, the simultaneous driving mechanism 133 includes a guide 145, an electric rotary motor 146, a slider 147, a bias spring 148, and a motion conversion mechanism (not shown). The guide 145 is fixed, and extends in the left-right direction. The electric rotary motor 146 is mounted to the guide 145. The slider 147 extends in the left-right direction as with the guide 145, and is guided by the guide 145 to be able to make reciprocal motion in the left-right direction. The bias spring 148 biases the slider 147 leftward. The motion conversion mechanism is disposed between the guide 145 and the slider 147 to convert rotation of the electric rotary motor 146 into linear motion of the slider 147. When the electric rotary motor 146 is not actuated or driven, the motion conversion mechanism (not shown) becomes free, and is returned to the original state by the biasing force of the bias spring 148.

Figure 6A:
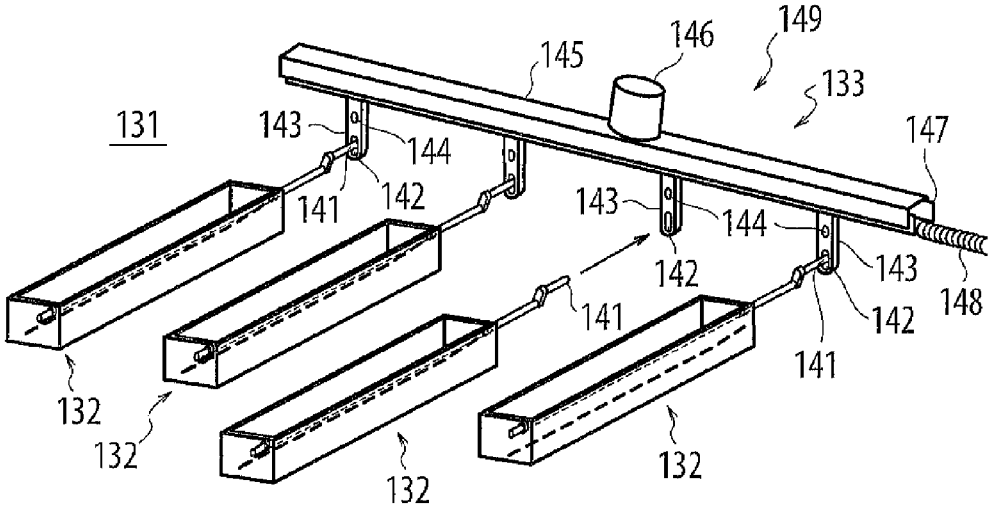
FIGS. 6*a* and 6*b* are each a perspective view of a temporary storage device.
Figure 6B:
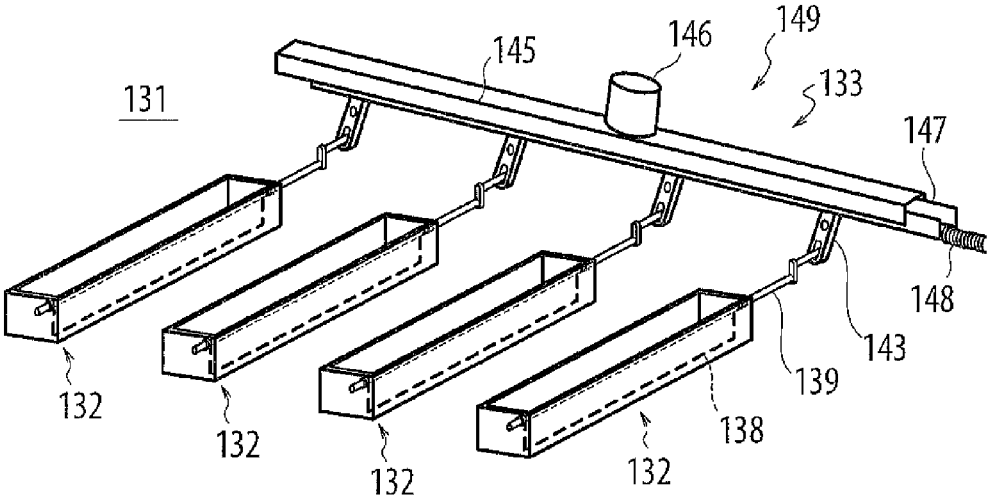

Thus, when the electric rotary motor 146 is not actuated, the slider 147 is moved to the leftmost position within its movable range by the biasing force of the bias spring 148 (see FIG. 6*a*). When the electric rotary motor 146 is actuated, the slider 147 makes linear motion to be moved rightward within its movable range (see FIG. 6*b*). After that, when operation of the electric rotary motor 146 is stopped, the slider 147 is moved again to the leftmost position within its movable range by the biasing force of the bias spring 148. A reciprocal linear motion mechanism 149 is constituted from such a structure.

The slider 147 of the reciprocal linear motion mechanism 149 is provided with a number of driving links 143, the number being the same as that of the temporary storage structures 132. The four driving links 143 are disposed side by side in the left-right direction at the same pitch as that of the temporary storage structures 132. The driving links 143 are each rotatably or swingably fixed to fulcrums 144 respectively (or rotatable within a predetermined angular range). For example, the upper end portion of each of the driving links 143 is rotatably coupled to the slider 147 with a rotating structure (not shown).

An elongated fitting hole 142 is formed in a swing portion of the driving link 143, that is, the lower end portion of the driving link 143 which is opposite to the slider 147. The width of the fitting hole 142 is slightly larger than the shaft diameter of the coupling shaft 141 of the temporary storage structure 132. Therefore, if the temporary storage structure 132 is pushed into the housing, the coupling shaft 141 is inserted into the fitting hole 142 so that the coupling shaft 141 and the fitting hole 142 are fitted with each other. If the temporary storage structure 132 is drawn forward out of the housing 110A, the coupling shaft 141 is extracted from the fitting hole 142 so that the coupling shaft 141 and the fitting hole 142 are removed from each other. Thus, the driving link 143 serves as a driving-side transmission member, and the coupling shaft 141 serves as a driven-side transmission member. The two transmission members form a transmission mechanism provided at the coupling portion between the simultaneous driving mechanism 133 and the temporary storage structure 132 to releasably establish engagement therebetween.

Figure 6C:
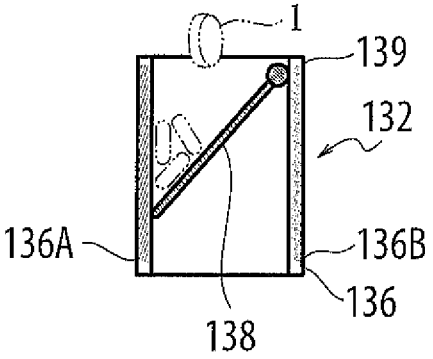
FIGS. 6*c* and 6*d* are each a vertical cross-sectional view of the temporary storage structure.
Figure 6D:
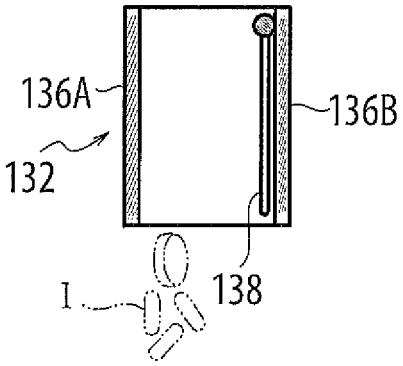
Figure 7A:
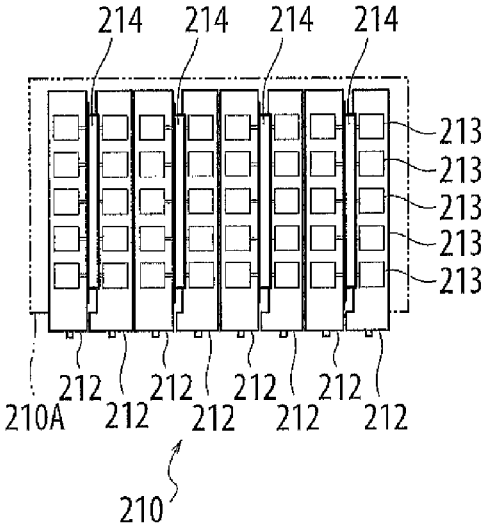
FIGS. 7*a* and 7*b* are each a plan view showing the structure of an essential portion of a tablet dispensing apparatus according to a second embodiment of the present invention.
Figure 7B:
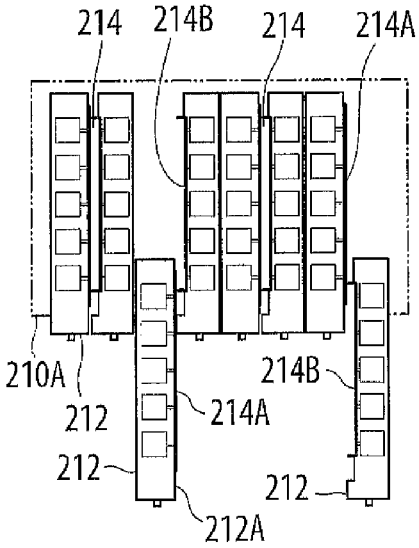
Figure 7C:
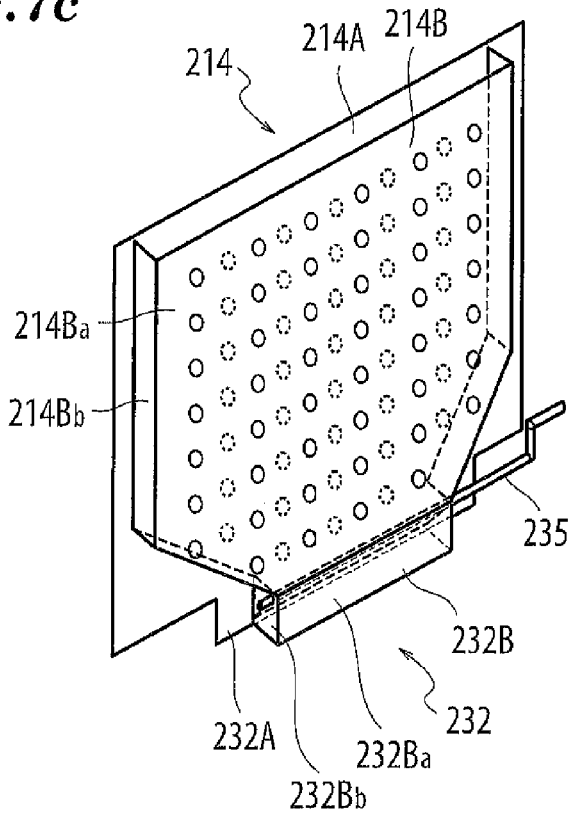
FIG. 7*c* is a perspective view of a medicine guide assembly and a temporary storage structure as seen from the right and obliquely above.
Figure 7D:
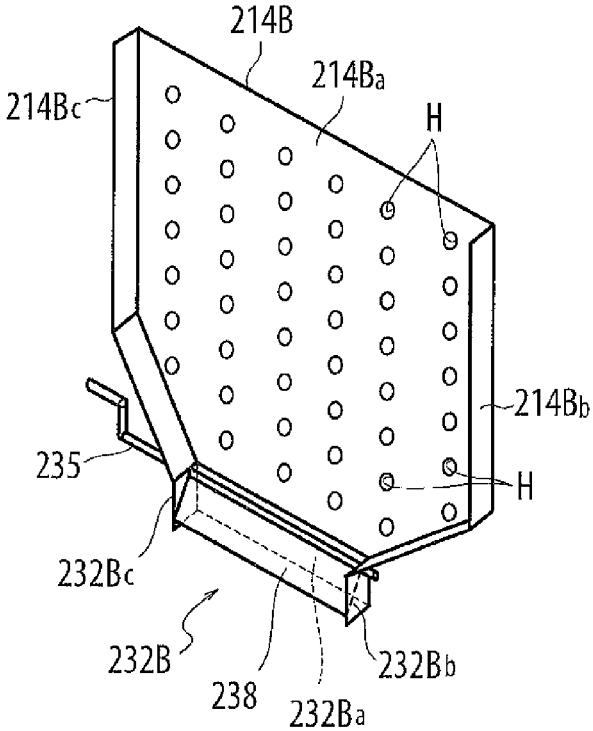
FIG. 7*d* is a perspective view of a second split guide member and a second split storage member as seen from the left and obliquely above.

When the electric rotary motor 146 is not actuated, as shown in FIG. 6*c*, the rotating shaft 139 of the temporary storage structure 132 is rotated in one direction over a predetermined angular range to bring the distal end of the shutter plate 138 into proximity to the sidewall portion 136A of the frame member 136, which brings the storage portion 134 formed above the shutter plate into the storage enabling state. When the electric rotary motor 146 is actuated, as shown in FIG. 6*d*, the rotating shaft 139 is rotated in the other direction over a predetermined angular range to bring the shutter plate 138 closer to the sidewall portion 136B, which brings the storage portion 134 into the releasing state.

The medicine collecting assembly 115 is disposed in the housing below the four temporary storage structures 132 to collect the medicines 1 dropped from the four temporary storage structures 132. The packing device 117 is provided in the housing 110A below the medicine collecting assembly 115 to separately pack the medicines discharged from the medicine collecting assembly 115.

The simultaneous driving mechanism 133 of the temporary storage device 131 does not have a tablet falling path surrounding surface. Thus, it is sufficient to clean the temporary storage structures 132 in regular cleaning work for the temporary storage device 131, with the exception of maintenance work such as disassembly and repair.

In a steady state such as during dispensing (see FIGS. 1 and 4), all the medicine feeder storing units 112 are pushed into the medicine storage 111 to be housed in the housing. Any of the medicine guide assemblies 114 can guide the falling tablets from the upper-end opening to the lower-end opening with the first split guide member 114A and the second split guide member 114B provided close and opposite to each other and with their inner opposite surfaces surrounding the tablet falling path. In addition, any of the temporary storage structures 132 surrounds the tablet falling path at the lower end portion of the corresponding medicine guide assembly 114. The simultaneous driving mechanism 133 drives the shutter plates 138 of the open-close mechanisms 135 to open and close the tablet falling path. In a closed state, the medicines (tablets) 1 discretely dropped can be temporarily stored (see FIG. 6*c*). When opened, the stored tablets can be released at a time (see FIG. 6*d*).

When cleaning the medicine guide assembly 114 and the temporary storage structure 132, the automatic dispensing operation discussed already is stopped, and the first split guide member 114A of the medicine guide assembly 114 and the second split guide member 114B of the medicine guide assembly 114 and the temporary storage structure 132 are separately cleaned. More particularly (see FIG. 2), first, only one of a pair of adjacent medicine feeder storing units 112 is drawn forward out of the medicine storage 111. If the left one of the pair of adjacent medicine feeder storing units 112 is drawn out, the first split guide member 114A forming the medicine guide assembly 114 is moved out of the housing 110A, and the entire tablet falling path surrounding surface of the first split guide member 114A is exposed to be cleaned by wiping or the like.

After that, the cleaned medicine feeder storing unit 112 is pushed back into the medicine storage 111, and the right one of the pair of adjacent medicine feeder storing units 112 is drawn forward out of the medicine storage 111. Then, the second split guide member 114B of the medicine guide assembly 114 and temporary storage structure 132 attached thereto are moved out of the housing 110A to expose the entire tablet falling path surrounding surfaces formed by the second split guide member 114B and the temporary storage structure 132. After the tablet falling path surrounding surfaces are cleaned by wiping or the like, the cleaned medicine feeder storing unit 112 pushed back into the medicine storage 111. In this way, all the tablet falling path surrounding surfaces of the medicine guide assembly 114 and the temporary storage structure 132 can be cleaned. In addition, the tablet falling path surrounding surfaces can be comfortably cleaned one by one in a standing posture as if wiping a window from inside.

FIG. 7 illustrates an essential portion of a tablet dispensing apparatus 210 according to a second embodiment of the present invention. Component parts similar to those in the first embodiment shown in FIGS. 1 to 6 are denoted by reference numerals obtained by adding 100 to the reference numerals affixed to their counterparts in FIGS. 1 to 6 to omit descriptions. FIG. 7*a* is a plan view of medicine guide assemblies 214 etc. with all medicine feeder storing units 212 pushed into a housing 210A. FIG. 7*b* is a plan view of the medicine guide assemblies 214 etc. with some of the medicine feeder storing units 212 drawn forward out of the housing 210A. FIG. 7*c* is a perspective view of a medicine guide assembly 214 constituted from a first split guide member 214A and a second split guide member 214B and a temporary storage structure 232 constituted from a first split storage member 232A and a second split storage member 232B as seen from the right and obliquely above. FIG. 7*d* is a perspective view of an assembly constituted from the second split guide member 214B of the medicine guide assembly 214 and the second split storage member 232B of the temporary storage structure 232 as seen from the left and obliquely above.

The tablet dispensing apparatus 210 is different from the tablet dispensing apparatus 110 according to the first embodiment discussed above in that the integral temporary storage structure 132 is replaced with the first split storage member 232A and the second split storage member 232B. That is, the temporary storage structures 232 are each constituted from first and second split storage members 232A and 232B that are combined with each other when the pair of adjacent medicine feeder storing units 212 are housed in the housing 210A and that are separated from each other when one of the pair of medicine feeder storing units 212 is drawn out of the housing 210A. The first split storage member 232A of the temporary storage structure 232 is integrally coupled to the first split guide member 214A of the medicine guide assembly 214. The second split storage member 232B of the temporary storage structure 232 serves as a portion including an open-close mechanism 235, and is coupled to the second split guide member 214B of the medicine guide assembly 214. The first split storage member 232A has the shape of a plate integrally formed with the first split guide member 214A. The second split storage member 232B includes an extended plate-like portion 232Ba, a first extended sidewall portion 232Bb, and a second extended sidewall portion 232Bc. The extended plate-like portion 232Ba is integrally formed with a plate-like portion 214Ba of the second split guide member 214B. The first extended sidewall portion 232Bb extends along a first edge portion of the extended plate-like portion 232Ba, which is located in a drawing direction in which the medicine feeder storing unit 212 is drawn, and extends in a direction away from the extended plate-like portion 232Ba to be continuous with a first sidewall portion 214Bb of the second split guide member 214B. The second extended sidewall portion 232Bc extends along a second edge portion of the extended plate-like portion 232Ba, which is located in the direction opposite to the drawing direction, and extends in a direction away from the extended plate-like portion 232Ba to be continuous with a second sidewall portion 214Bc of the second split guide member 214B.

Although not shown, the second split storage member 232B is provided with means for restricting the swing range of a shutter plate 238 to prevent the shutter plate 238 from moving out beyond the first and second extended sidewall portions 232Bb and 232Bc even if the second split storage member 232B is separated from the first split storage member 232A.

In this case, if only one of the two adjacent medicine feeder storing units 212 is drawn forward out of the housing 210A, one of the first split guide member 214A and the second split guide member 214B of the medicine guide assembly 214 is moved out of the housing 210A, and in accompaniment thereto, one of the first split storage member 232A combined with the first split guide member 214A and the second split storage member 232B combined with the second split guide member 214B is also moved out of the housing 210A. Thus, the tablet falling path surrounding surfaces of the first split guide member 214A and the first split storage member 232A, and the tablet falling path surrounding surfaces of the second split guide member 214B and the second split storage member 232B, can be cleaned by wiping or the like at the same time. The cleaning work can be performed in a standing posture as comfortably as wiping of a window from inside, thereby allowing the wiping or the like to be performed easily and immediately with the worker facing the surface to be cleaned.

Figure 8A:
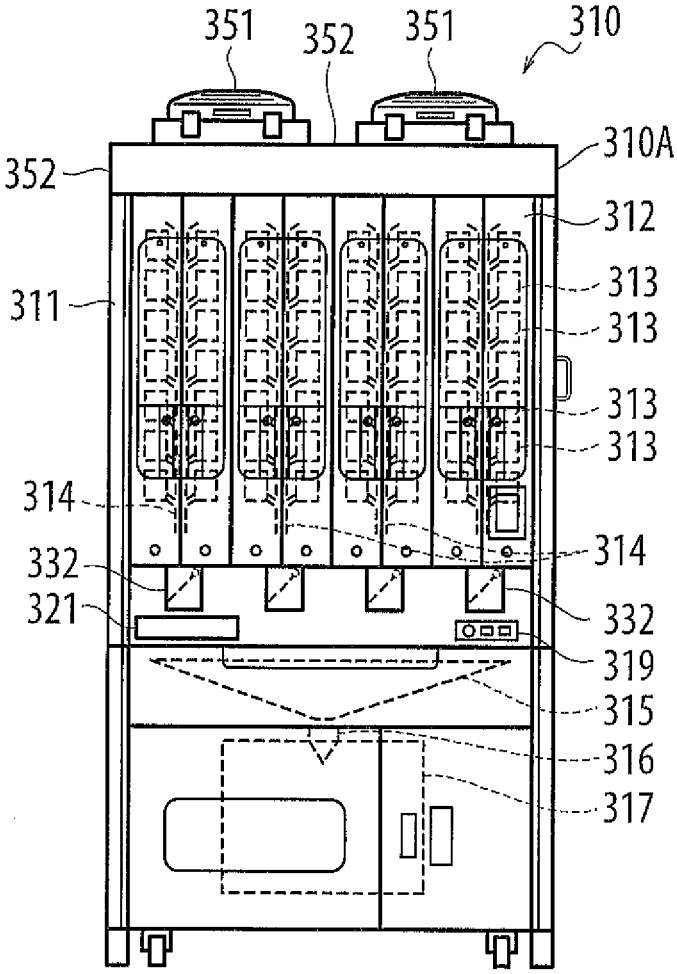
FIGS. 8*a* and 8*b* are a front view and a right side view, respectively, of a tablet dispensing apparatus according to a third embodiment of the present invention.
Figure 8B:
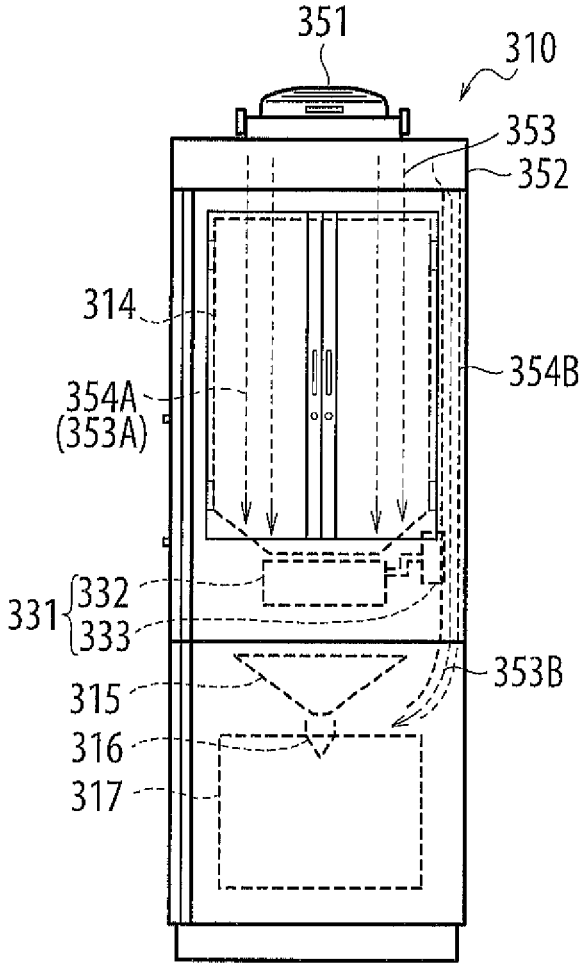

FIGS. 8*a* and 8*b* are a front view and a right side view, respectively, of a tablet dispensing apparatus 310 according to a third embodiment of the present invention. In FIG. 8, reference numerals obtained by adding 200 to the reference numerals used in the first embodiment shown in FIGS. 1 to 6 are used to omit descriptions. The tablet dispensing apparatus 310 according to the embodiment includes two air purifying devices 351 provided at the top plate portion of a housing 310A. The air purifying devices 351 purify air taken from outside of the housing 310A to supply the purified air into the housing 310A. An air supply chamber 352 is provided below the top plate portion of the housing 310A between the air purifying devices 351 and a medicine storage 311 to temporarily store purified air 353 discharged from the air purifying devices 351. The air purifying devices 351 are each a commercially available clean air supply unit obtained by combining a fan configured to blow an appropriate amount of air and a purifying member such as a HEPA filter or an ULPA filter. The air purifying devices 351 used in the embodiment take in air from a space above the housing 310A, purify the air to meet Class 1000 standards, for example, and feed the purified air into the air supply chamber 352 provided immediately therebelow. The air supply chamber 352 may temporarily store the purified air to mitigate fluctuations in air flow or air pressure, and may be formed from a simple box member.

Four medicine guide assemblies 314 communicate with the air supply chamber 352. The purified air supplied by the air purifying devices 351 into the housing 310A flows from top to bottom inside the medicine guide assemblies 314. Thus, the internal spaces of the four medicine guide assemblies 314 each form a purified air passage 354A to allow passage of at least a part (353A) of the purified air 353. Providing the thus configured purified air passage 354A allows the purified air 353 fed into the medicine guide assembly 314 from above to flow from top to bottom along the medicine falling path to be further fed into a medicine collecting assembly 315. As a result, the inside of the medicine guide assemblies 314 and the inside of the medicine collecting assembly 315 can be cleaned to some degree by the flow of the purified air.

The purified air having passed through the medicine guide assemblies 314 and the medicine collecting assembly 315 enters a packing device 317 together with the medicines while reducing its flow rate. However, the purified air is not enough to be used to clean the inside of the packing device 317. Thus, in the embodiment, a purified air branch passage 354B is provided to branch the purified air supplied from the air purifying devices 351 to allow a part (353B) of the branched purified air to directly flow to the surroundings of or into the packing device without passing through the purified air passage 354A. Specifically, as shown in FIG. 8*b*, the purified air branch passage 354B is formed by providing one or several air supply pipes each formed from a vertically placed duct on the back side in the housing 310A to communicate between the air supply chamber 352 and a lower space in the housing 310A in which the packing device 317 is disposed. Providing the purified air branch passage 354B allows the part (353B) of the purified air to be guided from the air supply chamber 352 to the lower space in the housing 310A, while bypassing the medicine guide assemblies 314, medicine feeder storing units 312, and the medicine collecting assembly 315, to be blown toward a medicine entry port 316 of the packing device 317. Providing the thus configured purified air branch passage 354B allows the packing device 317 to be reliably cleaned with the purified air. Although the purified air branch passage 354B formed from one or more air supply pipes is longer than the purified air passage 354A, the purified air branch passage 354B can be formed from a pipe such as a flexible hose, and thus can be conveniently implemented.

The air purifying devices 351 may be installed at any location if high-performance filters are used. If the air purifying devices 351 are disposed above the medicine feeder storing units 312 as in the embodiment, the air purifying devices 351 take in outside air at a location remote from the floor surface. Therefore, relatively uncontaminated air is taken into the air purifying devices 351.

One or more air contamination detectors are preferably disposed in the housing 310A to detect contamination of the purified air. Providing the air contamination detectors makes it possible to detect that the purified air in the housing 310A has been contaminated for some reason, and to take immediate measures against such contamination of the purified air. The contamination detectors may have any structure as long as the detectors detect contamination of air at their respective locations of installation. Examples of the contamination detector include an optical particle sensor, which is easy to use and inexpensive.

The one or more air contamination detectors may be disposed at any location on a flow passage that allows passage of the purified air supplied from the air purifying devices 351. Specifically, the air contamination detectors are preferably disposed at least one of: inside and outside of the purified air passages 354A, inside and in the vicinity of the exit port of the purified air branch passage 354B, inside and in the vicinity of the medicine collecting assembly 315, inside and in the vicinity of the packing device 317, and in the vicinity of the medicine entry port 316.

The results of detection by the air contamination detectors may be utilized in any way. For example, if the air contamination detectors detect contamination of the purified air, a controller serving as a control device for the air purifying devices 351 may vary the amount of air supplied by the air purifying devices 351 according to the degree of the detected contamination.

If the air contamination detectors detect that the purified air is contaminated to a prescribed level (degree) or more, an alarm signal generating device may generate an alarm signal.

Figure 9:
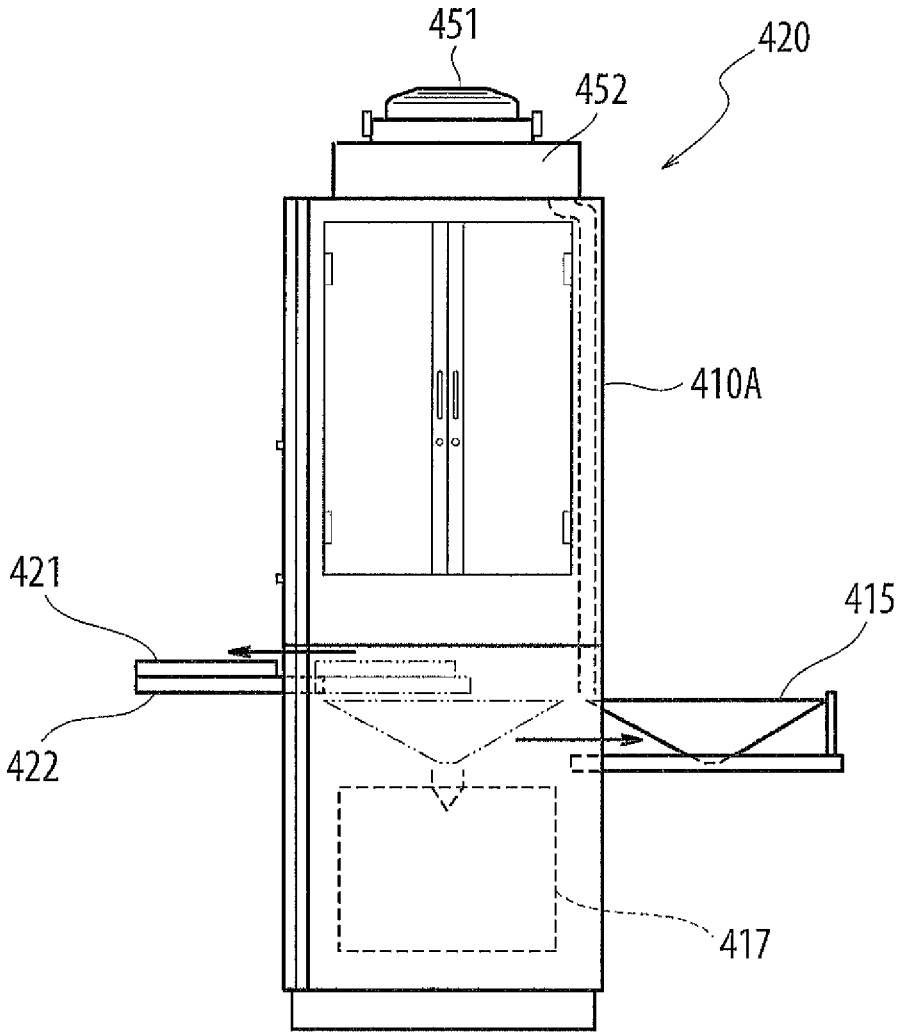
FIG. 9 is a side view of a tablet dispensing apparatus according to a fourth embodiment.
Figure 10A:
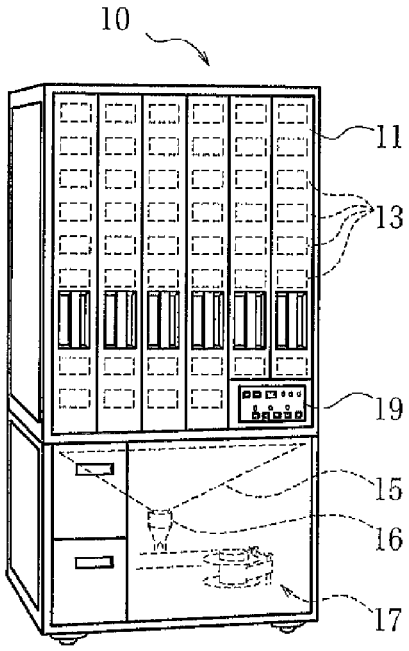
FIG. 10*a* is a perspective view showing the appearance of a tablet dispensing apparatus according to the related art as seen from the left front.
Figure 10B:
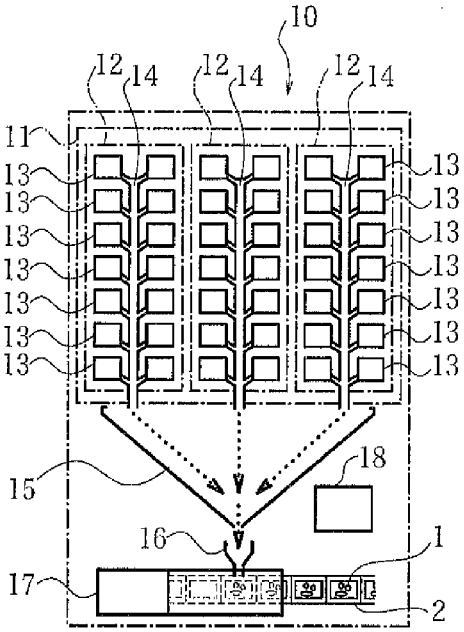
FIG. 10*b* is a schematic view showing the internal structure of the tablet dispensing apparatus according to the related art.
Figure 10C:
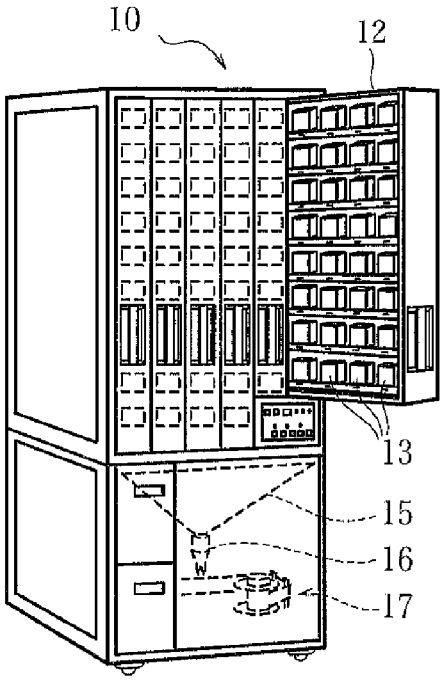
FIG. 10*c* is a perspective view showing the appearance of the tablet dispensing apparatus according to the related art as seen from the left front.
Figure 10D:
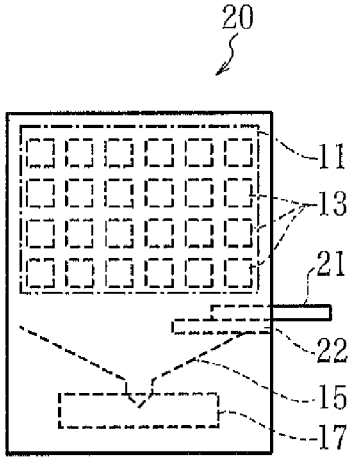
FIG. 10*d* is a left side view of a tablet dispensing apparatus with a manual tablet dispenser according to the related art.

While the present invention is applied to a tablet dispensing apparatus with no manual medicine dispenser in the embodiment of FIG. 8, it is a matter of course that the present invention may also be applied to a tablet dispensing apparatus 420 with a manual medicine dispenser as in a fourth embodiment shown in FIG. 9. In the embodiment shown in FIG. 9, component parts similar to those of the tablet dispensing apparatus with a manual medicine dispenser according to the related art shown in FIG. 8 are denoted by reference numerals obtained by adding 100 to the reference numerals affixed to their counterparts in FIG. 8. Also in the embodiment, as in the third embodiment, an air purifying device 451 is mounted on top of a housing 410A. A manual medicine dispenser (421, 422) includes a preliminary dispersing portion 421 of a cassette type and an operating portion 422 of a conveyor type. A large number of sectioned chambers are formed in the preliminary dispersing portion 421 in a vertical and horizontal arrangement. The upper side of each sectioned chamber is open to allow input of the medicines. The lower surface or the bottom surface of each sectioned chamber is formed from a shutter or the like to open and close to allow discharge of the medicines. The preliminary dispersing portion 421 can be drawn out of the housing of the tablet dispensing apparatus 420 to allow manually dispersion of the medicines into the sectioned chambers. While the medicines are manually put into the preliminary dispersing portion 421, the operating portion 422 automatically discharges the medicines. The operating portion 422 is configured to receive the medicines discharged from the sectioned chambers of the preliminary dispersing portion 421, and to feed the received medicines into a packing device 417 via a medicine collecting assembly 415, by an amount corresponding to one sectioned chamber at a time. When the manual medicine dispenser of the tablet dispensing apparatus 420 is not used, the tablet dispensing apparatus 420 operates as in the third embodiment with the manual medicine dispenser (421, 422) drawn out. When the manual medicine dispenser (421, 422) is used, supply of the medicines from the medicine feeders is stopped. It should be noted that the air purifying device 451 is in operation. As a result, the purified air flows from the air purifying device 451 into the housing 410A at all times to continue cleaning with the purified air.

[Other Embodiments]

A further modification is preferably made such that the coupling shaft 141 is smoothly inserted into the fitting hole 142 when the temporary storage structure 132 which has been disengaged from the simultaneous driving mechanism 133 becomes engaged therewith, although not shown or described in the embodiments described above. For example, the distal end of the coupling shaft 141 may be subjected to a tapering process or the like to be tapered. Biasing means such as a weak spring, for example, may be provided to force the temporary storage structure 132 closed in the absence of an external force to keep the coupling shaft 141 suitable for engagement. Means for restricting a movable range or a stop position may be individually provided for each of the driving links 143 and the coupling shafts 141 to allow individual adjustment of the range or the position.

Although the manual tablet dispenser (421, 422) is disposed below the temporary storage structures in the fourth embodiment described above, the manual tablet dispenser (421, 422) may be disposed above the temporary storage structures. For example, the lowermost tablet feeder may be replaced with the manual tablet dispenser (421, 422) in a certain medicine feeder storing unit. Then, the manual tablet dispenser 421+422 is located above the temporary storage structures, and drawn together with the medicine feeder storing unit. This facilitates cleaning, repair, etc. of the manual tablet dispenser (421, 422).

INDUSTRIAL APPLICABILITY

According to the present invention, the simultaneous driving mechanism and the plurality of temporary storage structures can be removably coupled to each other. Therefore, the temporary storage structures can be drawn out one by one, and cleaning work can be performed with only the subject of the cleaning work drawn out of the housing and with the other temporary storage structures pushed into the housing. Therefore, the cleaning work can be performed in a comfortable posture, and re-adhesion of removed substances to the other temporary storage structures can be prevented.

The air purifying devices are provided to take in air from outside of the housing to supply the purified air into the housing, and the purified air passage is provided inside the medicine guide assemblies to allow a flow of at least a part of the purified air from top to bottom. Then, the purified air fed from above into the medicine guide assemblies flows along the medicine falling path from top to bottom, and is further fed into the medicine collecting assembly. Thus, the inside of the medicine guide assemblies and the inside of the medicine collecting assembly can be cleaned to some degree by the flow of the purified air. Thus, the cleaning cycle of the inside of the medicine guide assemblies can be made longer than that according to the related art. The purified air passing through the inside of the medicine guide assemblies also serves to increase the falling speed of the medicines, thereby increasing the dispensing cycle.

SIGN LISTING

1 medicine
10 medicine dispensing apparatus
12 medicine feeder storing unit
30 medicine dispensing apparatus
42 air supply chamber
110 tablet dispensing apparatus
110A housing
111 medicine storage
112 medicine feeder storing unit
112A medicine feeder storing case
113 medicine feeder
114 medicine guide assembly
114A first split guide member
114B second split guide member
115 medicine collecting assembly
117 packing device
118 controller
119 operation panel
131 temporary storage device
132 temporary storage structure
133 simultaneous driving mechanism
134 storage portion
135 open-close mechanism
136 frame member
138 shutter plate
139 rotating shaft
140 arm
141 coupling shaft
143 driving link
144 fulcrum
145 guide
146 electric rotary motor
147 slider
148 bias spring
149 reciprocal linear motion mechanism

The invention claimed is:

1. A medicine dispensing apparatus comprising:

a housing;

a plurality of medicine feeder storing units drawably arranged in the housing and each including a plurality of medicine feeders configured to store medicines and to discharge the medicines one by one, and a medicine feeder storing case configured to store the plurality of medicine feeders;

a plurality of medicine guide assemblies each disposed between a pair of adjacent medicine feeder storing units among the plurality of medicine feeder storing units and configured to guide the medicines discharged from the plurality of medicine feeders included in the pair of medicine feeder storing units to one exit port located therebelow;

a plurality of temporary storage structures each including a storage portion configured to temporarily store the medicines dropped from the medicine guide assembly and an open-close mechanism configured to bring the storage portion into a storage enabling state upon application of a closing drive force and to bring the storage portion into a releasing state to discharge the medicines from the storage portion upon application of an opening drive force, the plurality of temporary storage structures being each provided such that the entire temporary storage structure or a portion including the open-close mechanism of the temporary storage structure is drawable out of the housing;

one simultaneous driving mechanism configured to apply the closing drive force or the opening drive force to the open-close mechanisms of the plurality of temporary storage structures;

a medicine collecting assembly disposed in the housing below the plurality of temporary storage structures to collect the medicines dropped from the plurality of temporary storage structures;

a packing device provided in the housing below the medicine collecting assembly to separately pack the medicines discharged from the medicine collecting assembly; and a plurality of coupling structures configured to couple the one simultaneous driving mechanism and the plurality of open-close mechanisms of the plurality of temporary storage structures, the coupling structures being each configured to release a coupling between the one simultaneous driving mechanism and the plurality of open-close mechanisms when the entire temporary storage structure or the portion including the open-close mechanism of the temporary storage structure is drawn out of the housing, and to establish the coupling between the one simultaneous driving mechanism and the plurality of open-close mechanisms when the entire temporary storage structure or the portion including the open-close mechanism of the temporary storage structure is pushed into the housing.

2. The medicine dispensing apparatus according to claim 1, wherein:

the medicine guide assemblies are each constituted from first and second split guide members that are combined with each other when the pair of medicine feeder storing units are housed in the housing and that are separated from each other when one of the pair of medicine feeder storing units is drawn out of the housing;

the first split guide member is fixed to the medicine feeder storing case of one of the pair of medicine feeder storing units, and the second split guide member is fixed to the medicine feeder storing case of the other of the pair of medicine feeder storing units; and the entire temporary storage structure is provided to one of the first and second split guide members.

3. The medicine dispensing apparatus according to claim 1, wherein:

the medicine guide assemblies are each constituted from first and second split guide members that are combined with each other when the pair of medicine feeder storing units are housed in the housing and that are separated from each other when one of the pair of medicine feeder storing units is drawn out of the housing;

the first split guide member is fixed to the medicine feeder storing case of one of the pair of medicine feeder storing units, and the second split guide member is fixed to the medicine feeder storing case of the other of the pair of medicine feeder storing units;

the temporary storage structures are each constituted from first and second split storage members that are combined with each other when the pair of medicine feeder storing units are housed in the housing and that are separated from each other when one of the pair of medicine feeder storing units is drawn out of the housing; and the first split storage member of the temporary storage structure is provided to the first split guide member of the medicine guide assembly, and the second split storage member of the temporary storage structure is provided to the second split guide member of the medicine guide assembly as the portion including the open-close mechanism of the temporary storage structure.

4. The medicine dispensing apparatus according to claim 2, wherein:

the first split guide member has a shape of a plate formed with a plurality of through holes configured to allow passage of the medicines discharged from the plurality of medicine feeders included in the one of the medicine feeder storing units; and the second split guide member includes a plate-like portion formed with a plurality of through holes configured to allow passage of the medicines discharged from the plurality of medicine feeders included in the other of the medicine feeder storing units, a first sidewall portion extending along a first edge portion of the plate-like portion, which is located in a drawing direction in which the medicine feeder storing unit is drawn, and extending in a direction away from the plate-like portion, and a second sidewall portion extending along a second edge portion of the plate-like portion, which is located in the direction opposite to the drawing direction, and extending in a direction away from the plate-like portion.

5. The medicine dispensing apparatus according to claim 4, wherein:

the first split storage member has a shape of a plate integrally formed with the first split guide member; and the second split storage member includes an extended plate-like portion integrally formed with the plate-like portion of the second split guide member, a first extended sidewall portion extending along a first edge portion of the extended plate-like portion, which is located in a drawing direction in which the medicine feeder storing unit is drawn, and extending in a direction away from the extended plate-like portion to be continuous with the first sidewall portion, and a second extended sidewall portion extending along a second edge portion of the extended plate-like portion, which is located in the direction opposite to the drawing direction, and extending in a direction away from the extended plate-like portion to be continuous with the second sidewall portion.

6. The medicine dispensing apparatus according to claim 1, wherein:

the open-close mechanisms of the temporary storage structures each include a shutter plate provided in the storage portion and being displaceable between a closed position and an opened position, and a driven link coupled to the shutter plate to displace the shutter plate by the closing drive force or the opening drive force from the one simultaneous driving mechanism; and the driven link is coupled to the one simultaneous driving mechanism through the coupling structure.

7. The medicine dispensing apparatus according to claim 6, wherein:

the driven link includes a rotating shaft to which the shutter plate is fixed and which is rotatably supported by the storage portion, an arm that has one end fixed to the rotating shaft and that is rotatable about the rotating shaft over a predetermined angular range, and a coupling shaft fixed to the other end of the arm and extending in parallel with the rotating shaft;

the one simultaneous driving mechanism includes a driving link having an elongated fitting hole fitted with the coupling shaft, and a swing motion generating mechanism configured to cause the driving link to make swing motion to rotate the rotating shaft within the predetermined angular range, with the coupling shaft reciprocally moving in the fitting hole; and the coupling structure is constituted from the coupling shaft and the fitting hole.

8. The medicine dispensing apparatus according to claim 7, wherein:

the swing motion generating mechanism includes a reciprocal linear motion mechanism with a movable portion configured to make reciprocal linear motion; and the driving links for the plurality of temporary storage structures are rotatably fixed to fulcrums respectively, one end of each of the driving links being rotatably coupled to the movable portion of the reciprocal linear motion mechanism, and the other end of each of the driving links being formed with the elongated hole.

9. The medicine dispensing apparatus according to claim 7, wherein:

the temporary storage structures each include an elongated frame member having an upper-end opening portion and a lower-end opening portion, the rotating shaft being disposed adjacent to the upper-end opening portion and one sidewall portion of the frame member and extending along the longitudinal direction of the frame member, the one side wall being located at one side in a width direction that is orthogonal to a longitudinal direction of the frame member;

the storage portion is brought into the storage enabling state when the rotating shaft is rotated in one direction in the predetermined angular range to bring a distal end of the shutter plate into proximity to the other sidewall portion that is opposite to the one sidewall portion in the width direction; and the storage portion is brought into the releasing state when the rotating shaft is rotated in the other direction in the predetermined angular range to bring the shutter plate close to the one sidewall portion.

10. The medicine dispensing apparatus according to claim 1, further comprising:

an air purifying device configured to purify air taken from outside of the housing to supply the purified air into the housing;

a purified air passage configured to allow at least a part of the purified air to flow into the medicine guide assemblies from top to bottom; and a purified air branch passage configured to branch the purified air supplied from the air purifying device to allow a part of the branched purified air to directly flow into the packing device without passing through the purified air passage or the medicine collecting assemblies.

11. The medicine dispensing apparatus according to claim 10, wherein the air purifying device is disposed above the plurality of medicine feeder storing units.

12. The medicine dispensing apparatus according to claim 3, wherein:

the first split guide member has a shape of a plate formed with a plurality of through holes configured to allow passage of the medicines discharged from the plurality of medicine feeders included in the one of the medicine feeder storing units; and the second split guide member includes a plate-like portion formed with a plurality of through holes configured to allow passage of the medicines discharged from the plurality of medicine feeders included in the other of the medicine feeder storing units, a first sidewall portion extending along a first edge portion of the plate-like portion, which is located in a drawing direction in which the medicine feeder storing unit is drawn, and extending in a direction away from the plate-like portion, and a second sidewall portion extending along a second edge portion of the plate-like portion, which is located in the direction opposite to the drawing direction, and extending in a direction away from the plate-like portion.

13. The medicine dispensing apparatus according to claim 12, wherein:

the first split storage member has a shape of a plate integrally formed with the first split guide member; and the second split storage member includes an extended plate-like portion integrally formed with the plate-like portion of the second split guide member, a first extended sidewall portion extending along a first edge portion of the extended plate-like portion, which is located in a drawing direction in which the medicine feeder storing unit is drawn, and extending in a direction away from the extended plate-like portion to be continuous with the first sidewall portion, and a second extended sidewall portion extending along a second edge portion of the extended plate-like portion, which is located in the direction opposite to the drawing direction, and extending in a direction away from the extended plate-like portion to be continuous with the second sidewall portion.

* * * * *